US009678526B2

(12) United States Patent
Motozawa et al.

(10) Patent No.: US 9,678,526 B2
(45) Date of Patent: Jun. 13, 2017

(54) CURRENT GENERATION CIRCUIT, AND BANDGAP REFERENCE CIRCUIT AND SEMICONDUCTOR DEVICE INCLUDING THE SAME

(71) Applicant: Renesas Electronics Corporation, Kanagawa (JP)

(72) Inventors: Atsushi Motozawa, Kanagawa (JP); Yuichi Okuda, Kanagawa (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 14/669,352

(22) Filed: Mar. 26, 2015

(65) Prior Publication Data

US 2015/0293552 A1 Oct. 15, 2015

(30) Foreign Application Priority Data

Apr. 14, 2014 (JP) ..... 2014-082566

(51) Int. Cl.

| | |
|---|---|
| ***G05F 3/30*** | (2006.01) |
| *G05F 3/24* | (2006.01) |
| *G05F 3/26* | (2006.01) |

(52) U.S. Cl.

CPC ..... *G05F 3/30* (2013.01); *G05F 3/245* (2013.01); *G05F 3/267* (2013.01)

(58) Field of Classification Search

CPC ..... G05F 3/30; G05F 3/245; G05F 3/267
See application file for complete search history.

(56) References Cited

U.S. PATENT DOCUMENTS 8,786,358 B2 7/2014 Endo et al.
2002/0093325 A1* 7/2002 Ju ..... G05F 3/30 323/316

(Continued)

FOREIGN PATENT DOCUMENTS

JP 2011-81517 A 4/2011
JP 2011-198093 A 10/2011

OTHER PUBLICATIONS

Harry Neuteboom et al., A DSP-Based Hearing Instrument IC, IEEE Journal of Solid-State Circuits, Nov. 1997, p. 1790-1806, vol. 32, No. 11.

*Primary Examiner* — Jue Zhang
*Assistant Examiner* — Lakaisha Jackson
(74) *Attorney, Agent, or Firm* — Mattingly & Malur, PC

(57) ABSTRACT

A current generation circuit including a first and a second bipolar transistors, a current distribution circuit that makes a first current and a second current flow through the first and second bipolar transistors, respectively, the first current and the second current corresponding to a first control voltage, a first NMOS transistor disposed between the first bipolar transistor and the first current distribution circuit, a second NMOS transistor disposed between the second bipolar transistor and the first current distribution circuit, a first resistive element, a first operational amplifier that outputs the second control voltage to the gates of the first and the second NMOS transistors according to a drain voltage of the first NMOS transistor and a reference bias voltage, and a second operational amplifier that generates the first control voltage according to a drain voltage of the second NMOS transistor and the reference bias voltage.

10 Claims, 26 Drawing Sheets

(56) References Cited

U.S. PATENT DOCUMENTS

| | | | | |
|---|---|---|---|---|
| 2002/0196072 | A1* | 12/2002 | Rosa | G05F 3/205<br>327/540 |
| 2005/0140428 | A1* | 6/2005 | Tran | G05F 3/30<br>327/539 |
| 2009/0027958 | A1* | 1/2009 | Cha | G11C 16/30<br>365/185.2 |
| 2009/0121699 | A1* | 5/2009 | Park | G05F 3/30<br>323/313 |
| 2009/0128230 | A1* | 5/2009 | Roh | G05F 3/30<br>327/539 |
| 2010/0007324 | A1* | 1/2010 | Masson | G05F 3/30<br>323/313 |

* cited by examiner

CURRENT GENERATION CIRCUIT, AND BANDGAP REFERENCE CIRCUIT AND SEMICONDUCTOR DEVICE INCLUDING THE SAME

CROSS-REFERENCE TO RELATED APPLICATIONS

This application is based upon and claims the benefit of priority from Japanese patent application No. 2014-082566, filed on Apr. 14, 2014, the disclosure of which is incorporated herein in its entirety by reference.

BACKGROUND

The present invention relates to a current generation circuit, and a bandgap reference circuit and a semiconductor device including the same. For example, the present invention relates to a current generation circuit suitable for generating an accurate current, and a bandgap reference circuit and a semiconductor device including the aforementioned current generation circuit and suitable for continuously outputting a constant reference voltage irrespective of their temperature.

A bandgap reference circuit is required to continuously output a constant reference voltage irrespective of its temperature. A technique relating to a bandgap reference circuit is disclosed in H. Neuteboom, B. M. J. Kup, and M. Janssens, "A DSP-based hearing instrument IC", IEEE J. Solid-State Circuits, vol. 32, pp. 1790-1806, November 1997.

The bandgap reference circuit disclosed in H. Neuteboom, B. M. J. Kup, and M. Janssens, "A DSP-based hearing instrument IC", IEEE J. Solid-State Circuits, vol. 32, pp. 1790-1806, November 1997 generates a constant reference voltage irrespective of its temperature by giving positive temperature dependence to a current flowing through a current path formed by two bipolar transistors, an operational amplifier, and a resistive element, and feeding a current in proportion to the aforementioned current through a bipolar transistor in which the voltage between its base and emitter has negative temperature dependence.

Further, Japanese Unexamined Patent Application Publications No. 2011-198093 and No. 2011-81517 disclose a technique for reducing errors in a reference voltage caused by the offset voltage of an operational amplifier.

SUMMARY

The present inventors have found the following problem. The bandgap reference circuit disclosed in H. Neuteboom, B. M. J. Kup, and M. Janssens, "A DSP-based hearing instrument IC", IEEE J. Solid-State Circuits, vol. 32, pp. 1790-1806, November 1997 needs to accurately generate a current having positive temperature dependence in order to output a constant reference voltage irrespective of its temperature. However, since an operational amplifier is disposed on the current path through which the current having positive temperature dependence flows, errors occur in the current flowing through that current path due to the influence of the offset voltage of the operational amplifier.

Therefore, there is a problem that the current generation unit provided in the bandgap reference circuit disclosed in H. Neuteboom, B. M. J. Kup, and M. Janssens, "A DSP-based hearing instrument IC", IEEE J. Solid-State Circuits, vol. 32, pp. 1790-1806, November 1997 is affected by the offset voltage of the operational amplifier and hence cannot accurately generate the current having positive temperature dependence. As a result, there is a problem that this bandgap reference circuit cannot continuously output a constant reference voltage irrespective of its temperature. Other problems to be solved and novel features will be more apparent from the following description of certain embodiments taken in conjunction with the accompanying drawings.

A first aspect of the present invention is a current generation circuit including: first and second bipolar transistors; a first current distribution circuit that makes first and second currents flow between collectors and emitters of the first and second bipolar transistors, respectively, according to a first control voltage; a first NMOS transistor disposed between the first bipolar transistor and the first current distribution circuit, a gate of the first NMOS transistor being supplied with a second control voltage; a second NMOS transistor disposed between the second bipolar transistor and the first current distribution circuit, a gate of the second NMOS transistor being supplied with the second control voltage; a first resistive element disposed between the second NMOS transistor and the second bipolar transistor; a first operational amplifier that generates the second control voltage according to a drain voltage of the first NMOS transistor and a reference bias voltage; and a second operational amplifier that generates the first control voltage according to a drain voltage of the second NMOS transistor and the reference bias voltage.

Another aspect of the present invention is a current generation circuit including: first and second bipolar transistors; a current distribution circuit that makes first and second currents flow between collectors and emitters of the first and second bipolar transistors, respectively, based on a control voltage; a first NMOS transistor disposed between the first bipolar transistor and the current distribution circuit, a gate and a drain of the first NMOS transistor being connected to each other; a second NMOS transistor disposed between the second bipolar transistor and the current distribution circuit, a gate of the second NMOS transistor being connected to the gate and the drain of the first NMOS transistor; a first resistive element disposed between the second NMOS transistor and the second bipolar transistor; and an operational amplifier that generates the control voltage according to a drain voltage of each of the first and second NMOS transistors.

According to the above-described aspects, it is possible to provide a current generation circuit capable of generating an accurate current, and a bandgap reference circuit and a semiconductor device including the aforementioned current generation circuit and capable of continuously outputting a constant reference voltage irrespective of their temperature.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

Embodiments are explained hereinafter with reference to the drawings. It should be noted that the drawings are made in a simplified manner, and therefore the technical scope of the embodiments should not be narrowly interpreted based on those drawings. Further, the same components are assigned the same symbols and their duplicated explanations are omitted.

In the following embodiments, when necessary, the present invention is explained by using separate sections or separate embodiments. However, those embodiments are not unrelated with each other, unless otherwise specified. That is, they are related in such a manner that one embodiment is a modified example, an application example, a detailed example, or a supplementary example of a part or the whole of another embodiment. Further, in the following embodiments, when the number of elements or the like (including numbers, values, quantities, ranges, and the like) is mentioned, the number is not limited to that specific number except for cases where the number is explicitly specified or the number is obviously limited to a specific number based on its principle. That is, a larger number or a smaller number than the specific number may be also used.

Further, in the following embodiments, their components (including operation steps and the like) are not necessarily indispensable except for cases where the component is explicitly specified or the component is obviously indispensable based on its principle. Similarly, in the following embodiments, when a shape, a position relation, or the like of a component(s) or the like is mentioned, shapes or the likes that are substantially similar to or resemble that shape are also included in that shape except for cases where it is explicitly specified or they are eliminated based on its principle. This is also true for the above-described number or the like (including numbers, values, quantities, ranges, and the like).

First Embodiment

Figure 1:
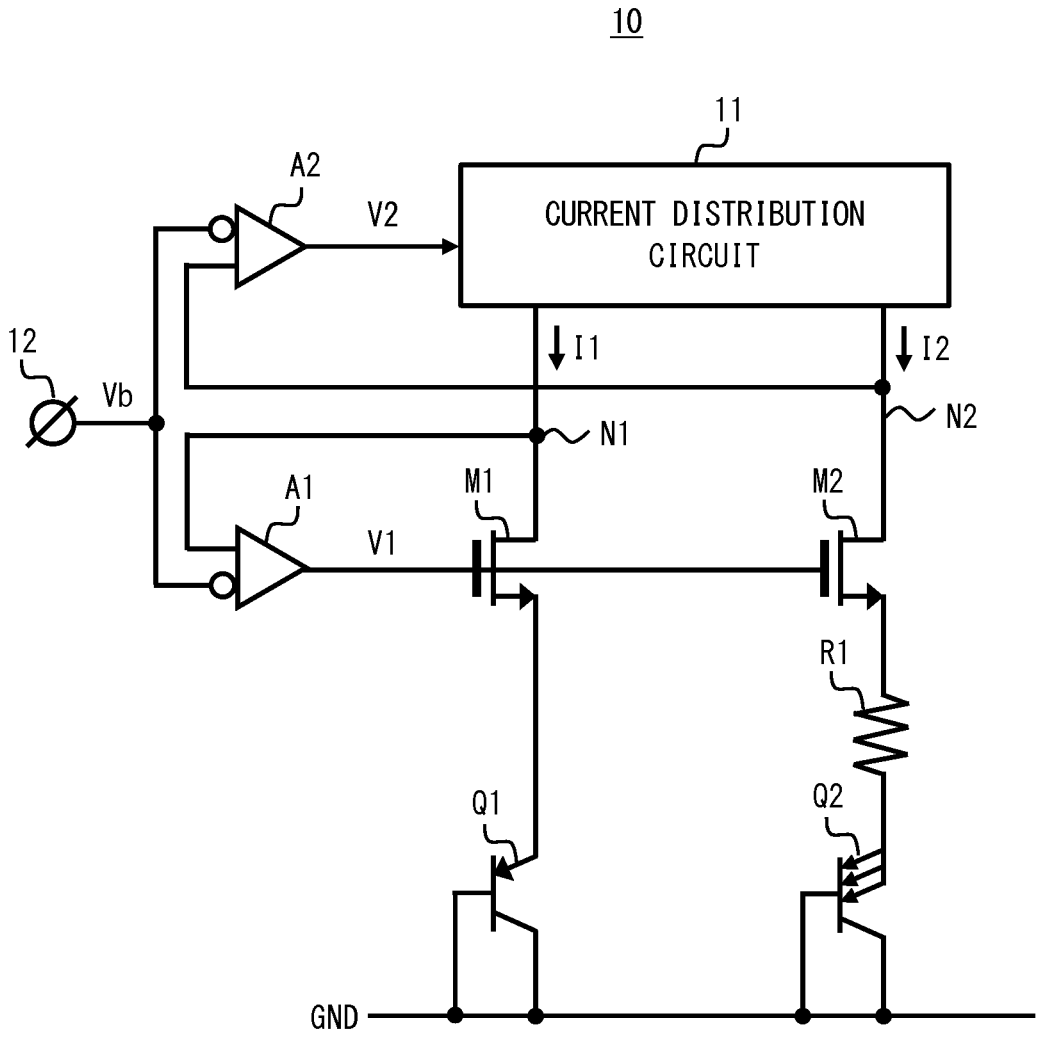
FIG. 1 is a circuit diagram showing a current generation circuit according to a first embodiment.

FIG. 1 is a circuit diagram showing a current generation circuit 10 according to a first embodiment. The current generation circuit 10 includes a gate grounding circuit in place of an operational amplifier on a current path whose current value increases as its temperature rises (i.e., a PTAT (Proportional To Absolute Temperature) current generation loop). As a result, the current generation circuit 10 eliminates the need for providing an operational amplifier on the PTAT current generation loop, thus making it possible to accurately generate an output current having positive temperature dependence. Detailed explanations are given hereinafter.

As shown in FIG. 1, the current generation circuit 10 includes a current distribution circuit 11, an N-channel type MOS transistor (first NMOS transistor) M1, an N-channel type MOS transistor (second NMOS transistor) M2, a PNP type bipolar transistor (first bipolar transistor) Q1, a PNP type bipolar transistor (second bipolar transistor) Q2, a resistive element (first resistive element) R1, an operational amplifier (second operational amplifier) A1, an operational amplifier (first operational amplifier) A2, and a reference bias source 12.

The base and collector of the bipolar transistor Q1 are connected to each other. The base and collector of the bipolar transistor Q2 are connected to each other. More specifically, the base and collector of the bipolar transistor Q1 are both connected to a ground voltage terminal (hereinafter referred to as "ground voltage terminal GND") to which a ground voltage GND is supplied. The base and collector of the bipolar transistor Q2 are both connected to the ground voltage terminal GND. In this embodiment, an example where the size (emitter size) of the bipolar transistor Q2 is n times (n is a positive number no less than 1) as large as the size (emitter size) of the bipolar transistor Q1 is explained.

The source of the MOS transistor M1 is connected to the emitter of the bipolar transistor Q1 and the drain of the MOS transistor M1 is connected to the current distribution circuit 11 through a node N1. Further, a control voltage V1 output from the operational amplifier A1 is supplied to the gate of the MOS transistor M1. The MOS transistor M1 serves as a cascode (gate grounding circuit).

The source of the MOS transistor M2 is connected to one end of the resistive element R1 and the drain of the MOS transistor M2 is connected to the current distribution circuit 11 through a node N2. Further, the control voltage V1 output from the operational amplifier A1 is supplied to the gate of the MOS transistor M2. The other end of the resistive element R1 is connected to the emitter of the bipolar transistor Q1. The MOS transistor M2 serves as a cascode (gate grounding circuit).

The current distribution circuit 11, which is, for example, a current mirror circuit, outputs a current I1 corresponding to a control voltage V2 output from the operational amplifier A2 and a current I2 in proportion to the current I1 to the nodes N1 and N2, respectively. These currents I1 and I2 flow between the collectors and emitters of the bipolar transistors Q1 and Q2, respectively.

(Details of Current Distribution Circuit 11)

Figure 2:
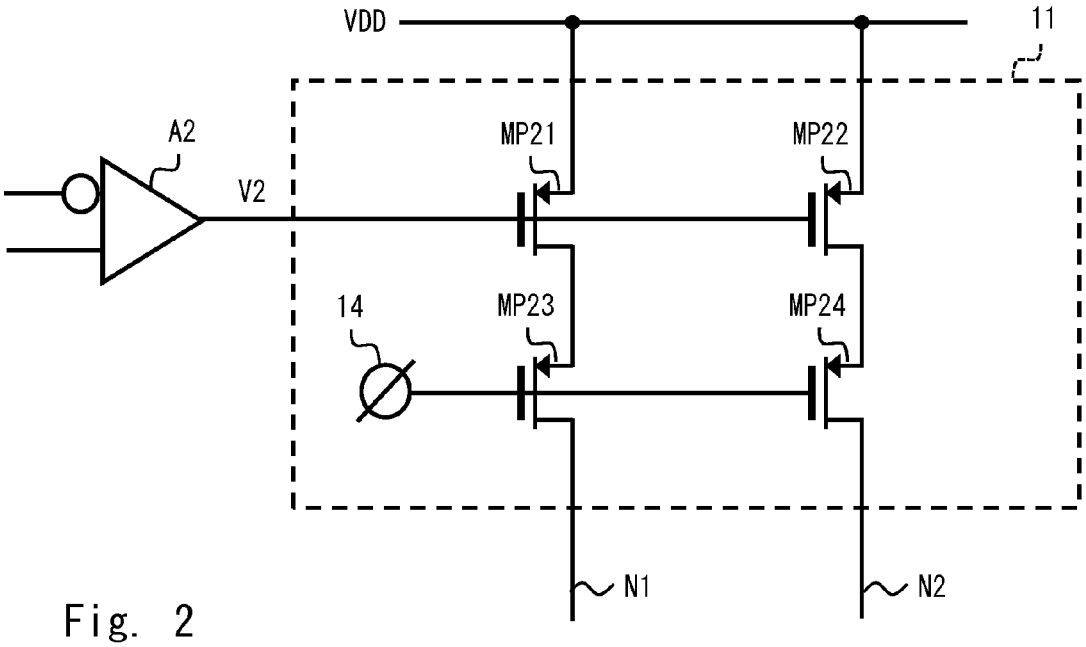
FIG. 2 is a circuit diagram showing details of a current distribution circuit provided in the current generation circuit shown in FIG. 1.

FIG. 2 is a circuit diagram showing details of the current distribution circuit 11. As shown in FIG. 2, the current distribution circuit 11 includes P-channel type MOS transistors MP21, MP22, MP23 and MP24, and a bias source 14.

The source of the MOS transistor MP21 is connected to a power supply voltage terminal (hereinafter referred to as "power supply voltage terminal VDD") to which a power supply voltage VDD is supplied, and the control voltage V2 output from the operational amplifier A2 is supplied to the gate of the MOS transistor MP21. The source of the MOS transistor MP23 is connected to the drain of the MOS transistor MP21, and the drain of the MOS transistor MP23 is connected to the node N1. Further, a bias voltage output from the bias source 14 is supplied to the gate of the MOS transistor MP23.

The source of the MOS transistor MP22 is connected to the power supply voltage terminal VDD, and the control voltage V2 output from the operational amplifier A2 is supplied to the gate of the MOS transistor MP22. The source of the MOS transistor MP24 is connected to the drain of the MOS transistor MP22, and the drain of the MOS transistor MP24 is connected to the node N2. Further, the bias voltage output from the bias source 14 is supplied to the gate of the MOS transistor MP24.

With the above-described configuration, a current I1 flows to the node N1 (i.e., between the collector and emitter of the bipolar transistor Q1), and a current I2, which is in proportion to the current I1, flows to the node N2 (i.e., between the collector and emitter of the bipolar transistor Q2).

For example, when the control voltage V2 is large, the on-resistance of each of the MOS transistors MP21 and MP22 increases. Therefore, the currents I1 and I2, which flow to the nodes N1 and N2, respectively, decrease. On the other hand, when the control voltage V2 is small, the on-resistance of each of the MOS transistors MP21 and MP22 decreases. Therefore, the currents I1 and I2, which flow to the nodes N1 and N2, respectively, increase.

(Details of Current Distribution Circuit 11*a*)

Figure 3:
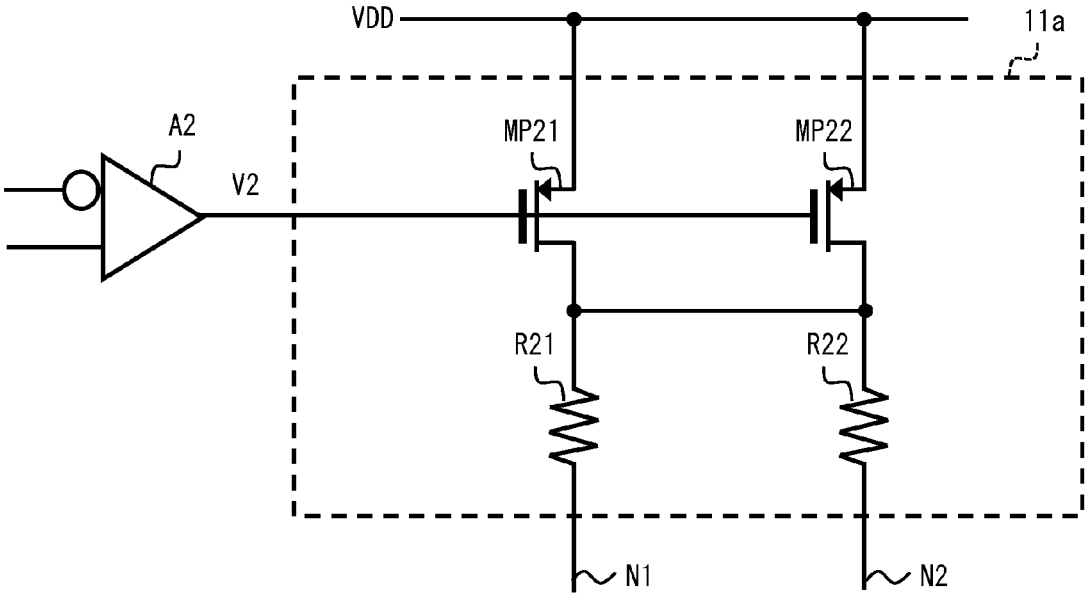
FIG. 3 is a circuit diagram showing a modified example of the current distribution circuit provided in the current generation circuit shown in FIG. 1.

FIG. 3 is a circuit diagram showing a modified example of the current distribution circuit 11 as a current distribution circuit 11*a*. As shown in FIG. 3, the current distribution circuit 11*a* includes P-channel type MOS transistors MP21 and MP22, and resistive elements R21 and R22.

The source of the MOS transistor MP21 is connected to the power supply voltage terminal VDD, and the control voltage V2 output from the operational amplifier A2 is supplied to the gate of the MOS transistor MP21. One end of the resistive element R21 is connected to the drain of the MOS transistor MP21 and the other end of the resistive element R21 is connected to the node N1.

The source of the MOS transistor MP22 is connected to the power supply voltage terminal VDD, and the control voltage V2 output from the operational amplifier A2 is supplied to the gate of the MOS transistor MP22. One end of the resistive element R22 is connected to the drain of the MOS transistor MP22 and the other end of the resistive element R22 is connected to the node N2. Further, the drains of the MOS transistors MP21 and MP22 are connected to each other.

With the above-described configuration, a current I1 flows to the node N1 (i.e., between the collector and emitter of the bipolar transistor Q1), and a current I2, which is in proportion to the current I1, flows to the node N2 (i.e., between the collector and emitter of the bipolar transistor Q2).

For example, when the control voltage V2 is large, the on-resistance of each of the MOS transistors MP21 and MP22 increases. Therefore, the currents I1 and I2, which flow to the nodes N1 and N2, respectively, decrease. On the other hand, when the control voltage V2 is small, the on-resistance of each of the MOS transistors MP21 and MP22 decreases. Therefore, the currents I1 and I2, which flow to the nodes N1 and N2, respectively, increase.

The current distribution circuit 11 can be changed or modified as desired to other configurations having functions equivalent to those of the configurations shown in FIGS. 2 and 3.

Here, FIG. 1 is referred to again. The operational amplifier A1 outputs, from its output terminal OUTA, the control voltage V1 according to a potential difference between a reference bias voltage Vb, which is supplied from the reference bias source 12 to its inverting input terminal INN, and the drain voltage of the MOS transistor M1 (a voltage at the node N1), which is supplied to its non-inverting input terminal INP.

The operational amplifier A2 outputs, from its output terminal OUTA, the control voltage V2 according to a potential difference between the reference bias voltage Vb, which is supplied from the reference bias source 12 to its inverting input terminal INN, and the drain voltage of the MOS transistor M2 (a voltage at the node N2), which is supplied to its non-inverting input terminal INP.

Since the two input terminals of the operational amplifier A1 are connected to an artificial ground and the two input terminals of the operational amplifier A2 are also connected to the artificial ground, the potential at the nodes N1 and N2 are substantially equal to each other.

(Details of Operational Amplifiers A1 and A2)

Figure 4:
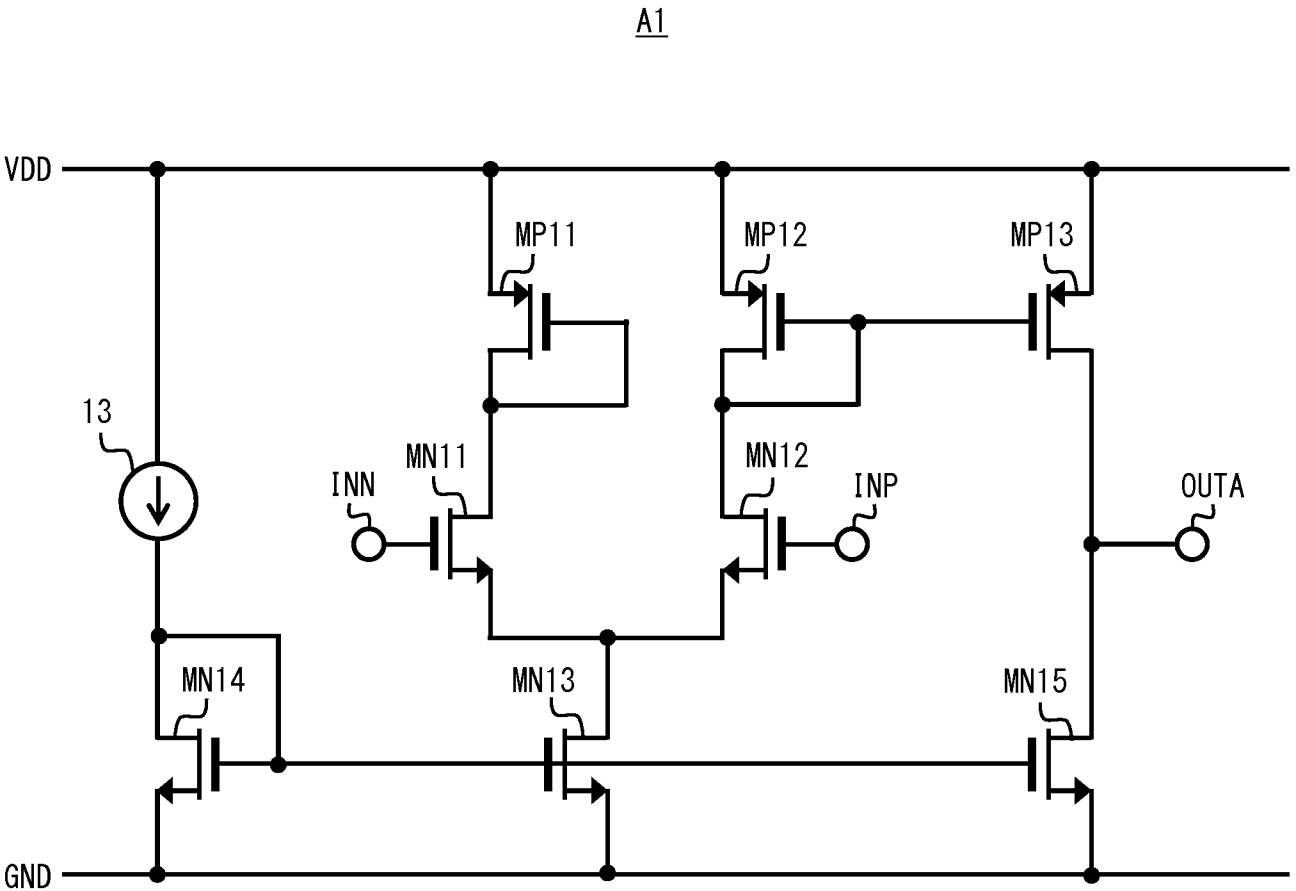
FIG. 4 is a circuit diagram showing an operational amplifier provided in the current generation circuit shown in FIG. 1.

FIG. 4 is a circuit diagram showing details of the operational amplifier A1. The configuration of the operational amplifier A2 is identical to that of the operational amplifier A1, and therefore only the operational amplifier A1 is explained hereinafter.

As shown in FIG. 4, the operational amplifier A1 includes P-channel type MOS transistors MP11 to MP13, N-channel type MOS transistors MN11 to MN15, and a constant current source 13. In this embodiment, an example where an input differential pair is formed by N-channel type MOS transistors is explained. However, the present invention is not limited to such examples. The input differential pair may be formed by P-channel type MOS transistors, provided that it works properly.

The constant current source 13 and the MOS transistor MN14 are connected in series between the power supply voltage terminal VDD and the ground voltage terminal GND. More specifically, the input terminal of the constant current source 13 is connected to the power supply voltage terminal VDD and the output terminal thereof is connected to the drain and gate of the MOS transistor MN14. The source of the MOS transistor MN14 is connected to the ground voltage terminal GND.

The source of the MOS transistor MP11 is connected to the power supply voltage terminal VDD, and the drain and gate of the MOS transistor MP11 are connected to the drain of the MOS transistor MN11. The source of the MOS transistor MN11 is connected to the drain of the MOS transistor MN13, and the gate of the MOS transistor MN11 is connected to the inverting input terminal INN.

The source of the MOS transistor MP12 is connected to the power supply voltage terminal VDD, and the drain and gate of the MOS transistor MP12 are connected to the drain of the MOS transistor MN12. The source of the MOS transistor MN12 is connected to the drain of the MOS transistor MN13, and the gate of the MOS transistor MN12 is connected to the non-inverting input terminal INP.

The source of the MOS transistor MN13 is connected to the ground voltage terminal GND, and the gate of the MOS transistor MN13 is connected to the drain and gate of the MOS transistor MN14.

The source of the MOS transistor MP13 is connected to the power supply voltage terminal VDD, and the drain of the MOS transistor MP13 is connected to the output terminal OUTA. Further, the gate of the MOS transistor MP13 is connected to the drain and gate of the MOS transistor MP12.

The source of the MOS transistor MN15 is connected to the ground voltage terminal GND, and the drain of the MOS transistor MN15 is connected to the output terminal OUTA. Further, the gate of the MOS transistor MN15 is connected to the drain and gate of the MOS transistor MN14.

Note that the configuration of each of the operational amplifiers A1 and A2 can be changed or modified as desired to other configurations having functions equivalent to those of the configurations shown in FIG. 4.

Further, the voltages Vbe1 and Vbe2 between the bases and emitters (hereinafter called "base-emitter voltages Vbe1 and Vbe2") of the bipolar transistors Q1 and Q2, respectively, have negative temperature dependence. That is, the base-emitter voltages Vbe1 and Vbe2 of the bipolar transistors Q1 and Q2, respectively, decrease as their temperature rises. Therefore, when the emitter size of the bipolar transistor Q2 is larger than that of the bipolar transistor Q1, a differential voltage ΔVbe between the voltages Vbe1 and Vbe2 (i.e., ΔVbe=Vbe1−Vbe2) has positive temperature dependence. That is, the differential voltage ΔVbe increases as the temperature rises.

Therefore, even for the current path formed by the bipolar transistor Q1, the MOS transistor M1, the MOS transistor M2, the resistive element R1, and the bipolar transistor Q2, it is possible to make a current having positive temperature dependence flows therethrough by adjusting the resistance value of the resistive element R1, the emitter size of the bipolar transistor Q2, and so on. This current path, thorough which a current having positive temperature dependence flows, is hereinafter referred to as "PTAT current generation loop".

No operational amplifier is disposed on this PTAT current generation loop. Therefore, no error is caused in the current flowing through this PTAT current generation loop due to the influence of the offset voltage of an operational amplifier. That is, the current generation circuit 10 can accurately generate a current having positive temperature dependence (e.g., the current I2).

Further, in the current generation circuit 10, the PTAT current generation loop including no operational amplifier is formed by using the PNP type bipolar transistors Q1 and Q2. Therefore, the current generation circuit 10 can be formed even in an environment where no NPN type bipolar transistor can be used.

Figure 5:
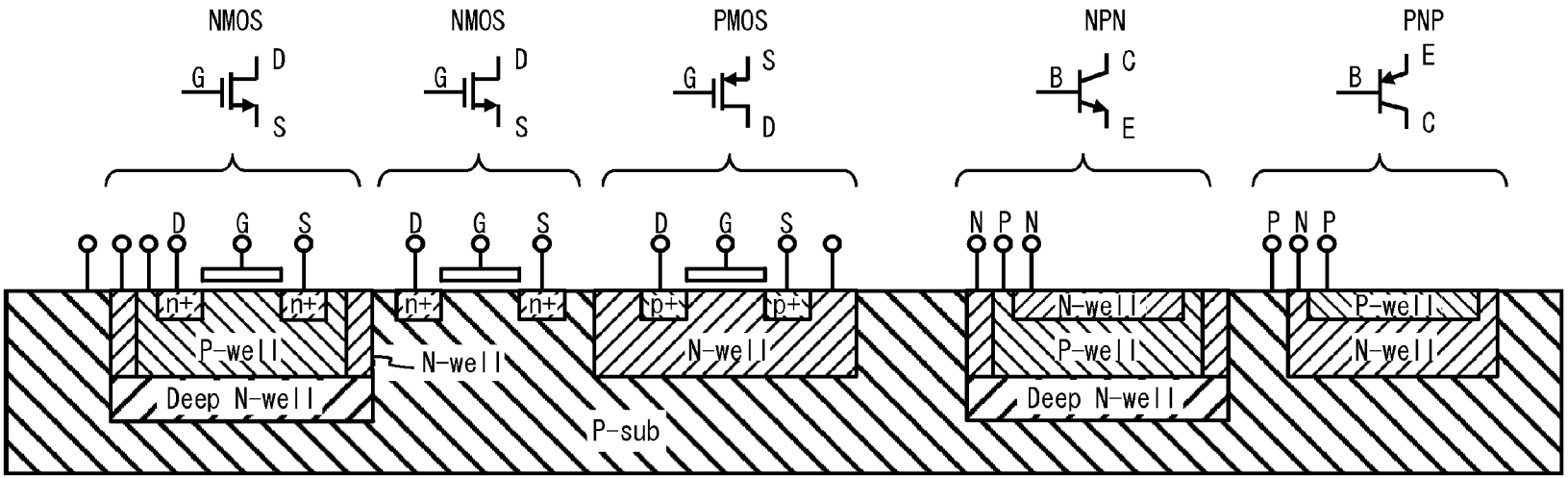
FIG. 5 is a cross section showing transistors formed in a triple well process.
Figure 6:
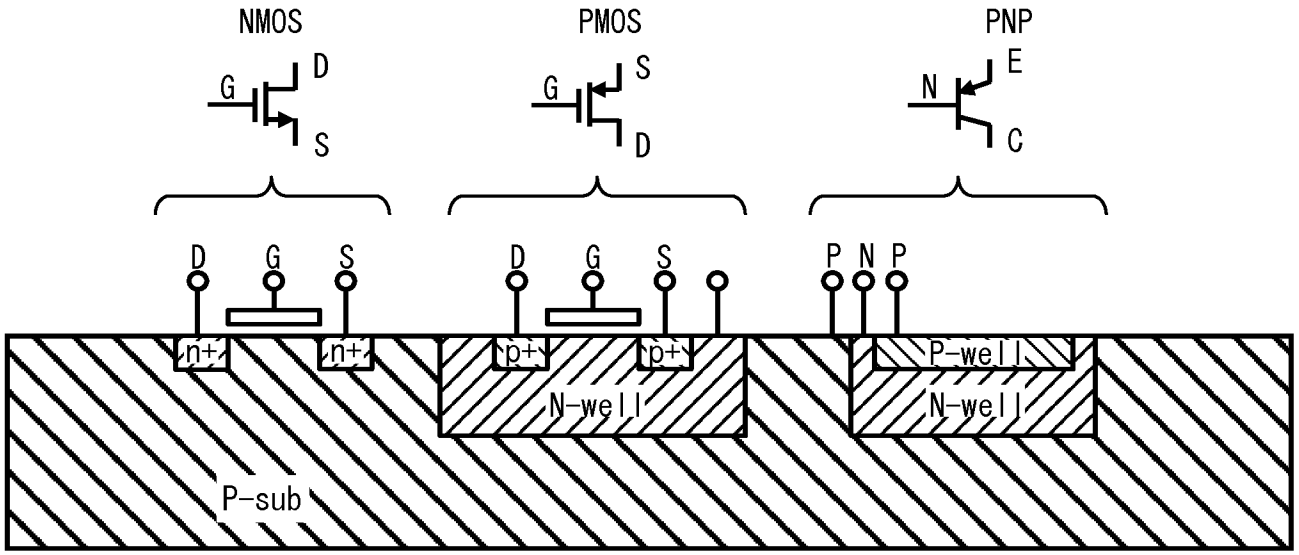
FIG. 6 is a cross section showing transistors formed in a single well process.

FIG. 5 is a cross section showing transistors formed in a triple well process. FIG. 6 is a cross section showing transistors formed in a single well process (an N-well process in this example).

In the triple well process, the P-sub is isolated from the P-well by forming a Deep-N well in the P-sub. As a result, it is possible to form NPN type bipolar transistors as well as PNP type bipolar transistors.

In contrast to this, in the single well process, no Deep-N well is formed in the P-sub. Therefore, although PNP type bipolar transistors can be formed, no NPN type bipolar transistor can be formed in the single well process.

The current generation circuit 10 can be formed not only in the triple well process but also in the single well process in which no NPN type bipolar transistor can be used.

Note that although an example where the PNP type bipolar transistors Q1 and Q2 are provided is explained in this embodiment, the present invention is not limited to such examples. That is, NPN type bipolar transistors Q1*a* and Q2*a* may be provided.

Figure 7:
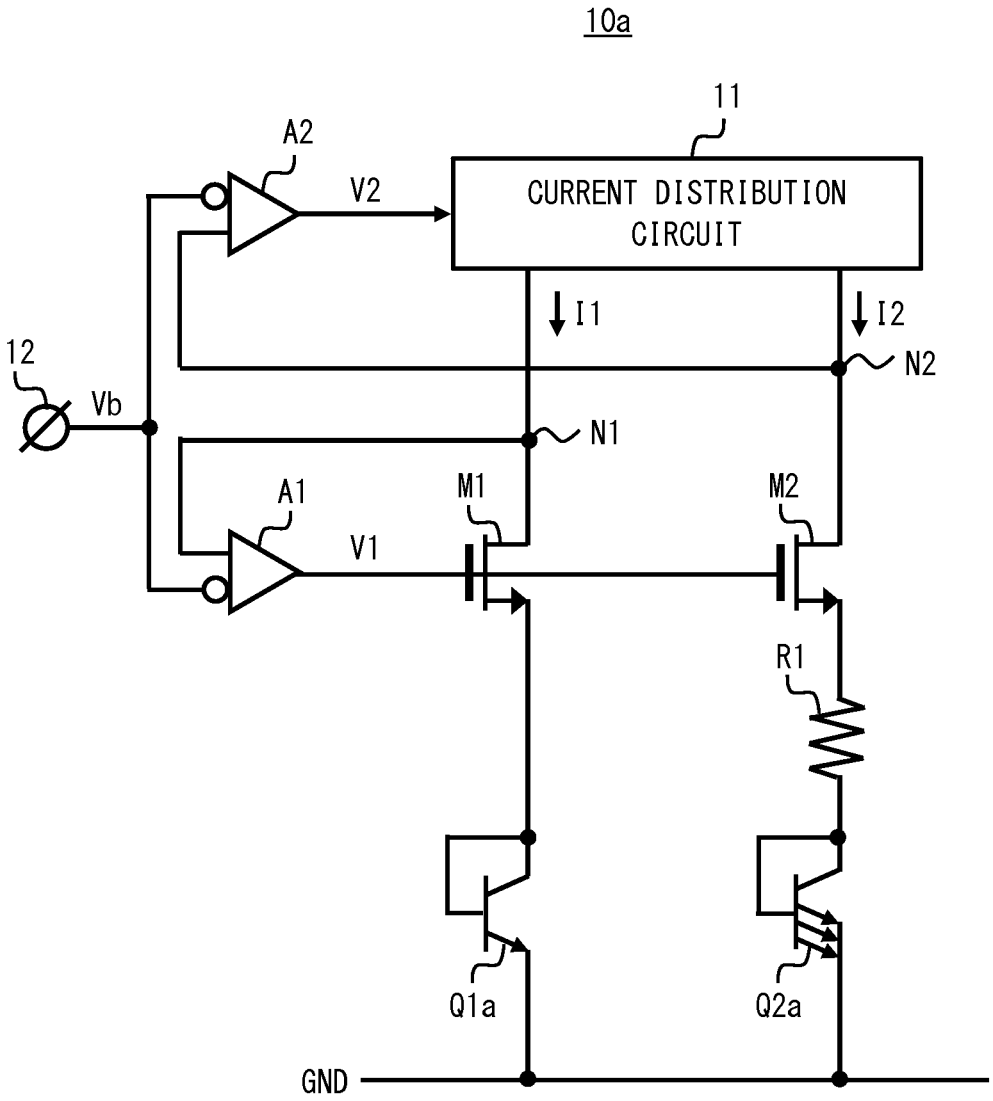
FIG. 7 is a circuit diagram showing a modified example of the current generation circuit shown in FIG. 1.

FIG. 7 is a circuit diagram showing a modified example of the current generation circuit 10 as a current generation circuit 10*a*.

As shown in FIG. 7, in comparison to the current generation circuit 10, the current generation circuit 10*a* includes NPN type bipolar transistors Q1*a* and Q2*a* in place of the PNP type bipolar transistors Q1 and Q2. Note that since the current generation circuit 10*a* includes the NPN type bipolar transistors Q1*a* and Q2*a*, the current generation circuit 10*a* needs to be formed in a triple well process. The other configuration of the current generation circuit 10*a* is similar to that of the current generation circuit 10, and therefore its explanation is omitted.

The current generation circuit 10*a* provides advantageous effects similar to those of the current generation circuit 10.

Second Embodiment

Figure 8:
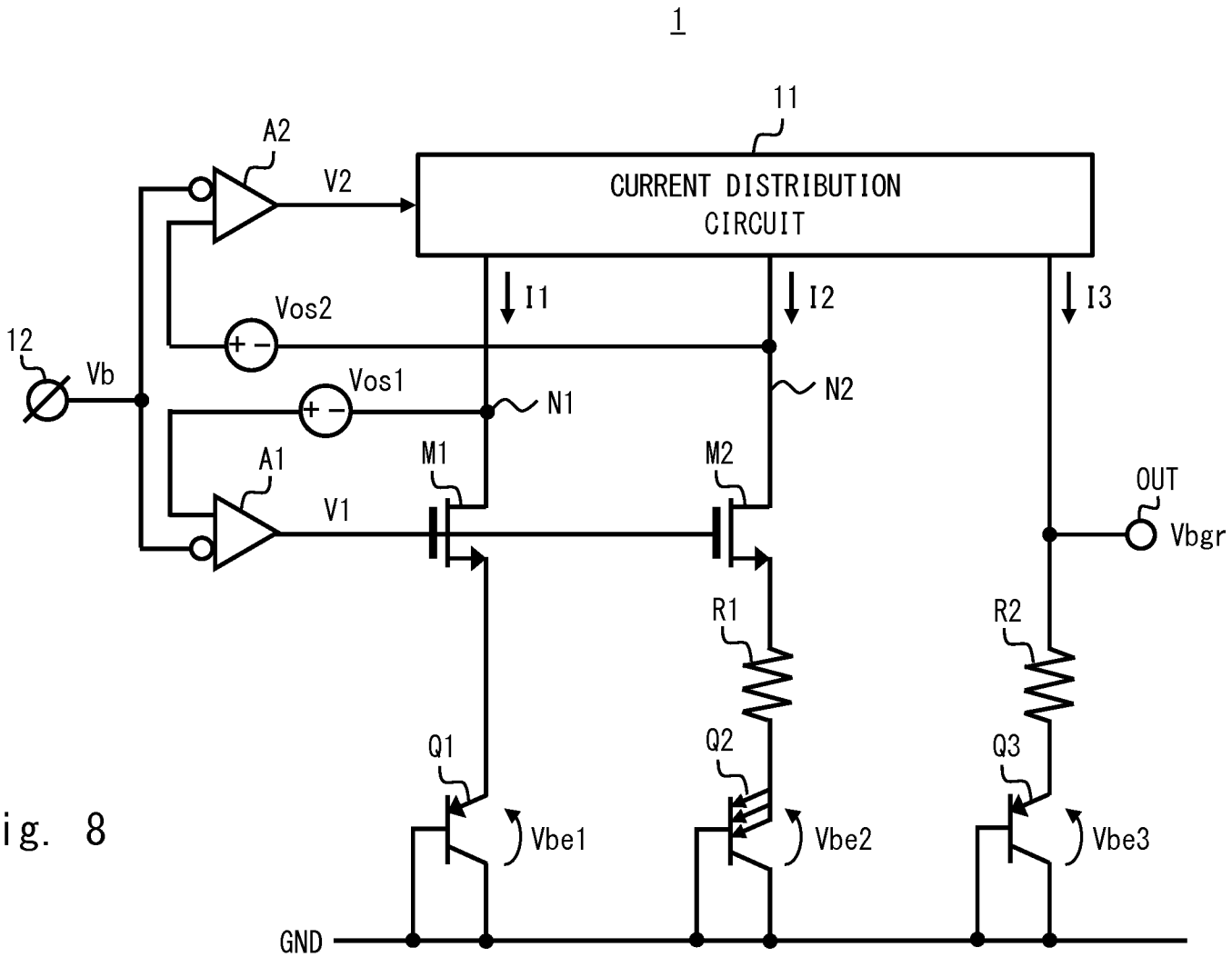
FIG. 8 is a circuit diagram showing a bandgap reference circuit according to a second embodiment.

FIG. 8 is a circuit diagram showing a bandgap reference circuit 1 according to a second embodiment. Note that the current generation circuit 10 is applied in the bandgap reference circuit 1.

As shown in FIG. 8, the bandgap reference circuit 1 includes, in addition to the current distribution circuit 11, the MOS transistors M1 and M2, the bipolar transistors Q1 and Q2, the operational amplifiers A1 and A2, the resistive element R1, and the reference bias source 12, which constitute the current generation circuit 10, a resistive element (second resistive element) R2 having a fixed resistance, and a bipolar transistor (third bipolar transistor) Q3. Since the current generation circuit 10 is already explained above, the configuration other than the current generation circuit 10 is explained hereinafter.

The bipolar transistor Q3 is a PNP type bipolar transistor, i.e., a bipolar transistor having the same conductivity type as that of the bipolar transistors Q1 and Q2. Further, in this example, the size (emitter size) of the bipolar transistor Q3 is equal to the size (emitter size) of the bipolar transistor Q1.

The base and collector of the bipolar transistor Q3 are connected to each other. More specifically, the base and collector of the bipolar transistor Q3 are both connected to the ground voltage terminal GND.

The resistive element R2 is disposed between the emitter of the bipolar transistor Q3 and the current distribution circuit 11.

The current distribution circuit 11 outputs, in addition to the currents I1 and I2, a current I3 in proportion to these currents I1 and I2. This current I3 flows through the resistive element R2 and between the collector and emitter of the bipolar transistor Q3.

Further, the bandgap reference circuit 1 externally outputs a voltage at a node on the current path extending from the current distribution circuit 11 to the resistive element R2 as a reference voltage Vbgr from its output terminal OUT.

Note that the bandgap reference circuit 1 can generate a constant reference voltage Vbgr irrespective of its temperature by making the current I3 having positive temperature dependence output from the current distribution circuit 11 flow through the bipolar transistor Q3 whose base-emitter voltage Vbe3 has negative temperature dependence.

Further, in the bandgap reference circuit 1, the PTAT current generation loop including no operational amplifier is formed by using the PNP type bipolar transistors. Therefore, the bandgap reference circuit 1 can also be formed in a single well process and the like in which no NPN type bipolar transistor can be used.

Next, it is explained how much the influence of the offset voltage of an operational amplifier can be reduced by eliminating the operational amplifier from the PTAT current generation loop. Note that the ratio among the emitter sizes of the bipolar transistors Q1 to Q2 is expressed as "1:n:1"

Firstly, the base-emitter voltages Vbe1 and Vbe2 of the bipolar transistors Q1 and Q2, respectively, are expressed by the below-shown Expressions (1) and (2).

[Expression 1]

$$Vbe1 = Vt \cdot \ln\left(\frac{I1}{Js \cdot A}\right) \tag{1}$$

[Expression 2]

$$Vbe2 = Vt \cdot \ln\left(\frac{I2}{n \cdot Js \cdot A}\right) \tag{2}$$

In the expressions, Js represents the saturation current density of the bipolar transistor and A represents the unit size. Further, the relation "Vt=kT/q" holds, where: k is Boltzmann constant; T is an absolute temperature; and q is an elementary charge.

Note that based on the current path from the ground voltage terminal GND to the gate of the MOS transistor M1 through the bipolar transistor Q1 and the current path from the ground voltage terminal GND to the gate of the MOS transistor M2 through the bipolar transistor Q2, a potential difference between the ground voltage terminal GND and the control voltage V1 of the operational amplifier A1 is expressed by the below-shown Expression (3).

[Expression 3]

$$Vbe1+Vgs1=Vbe2+R1 \cdot I2+Vgs2 \tag{3}$$

In the expression, Vgs1 and Vgs2 represent the voltages between the gates and sources (hereinafter called "gate-source voltages") of the MOS transistors M1 and M2, respectively; R1 represents the resistance value of the resistive element R1; and I2 represents the current value of the current I2.

Figure 9:
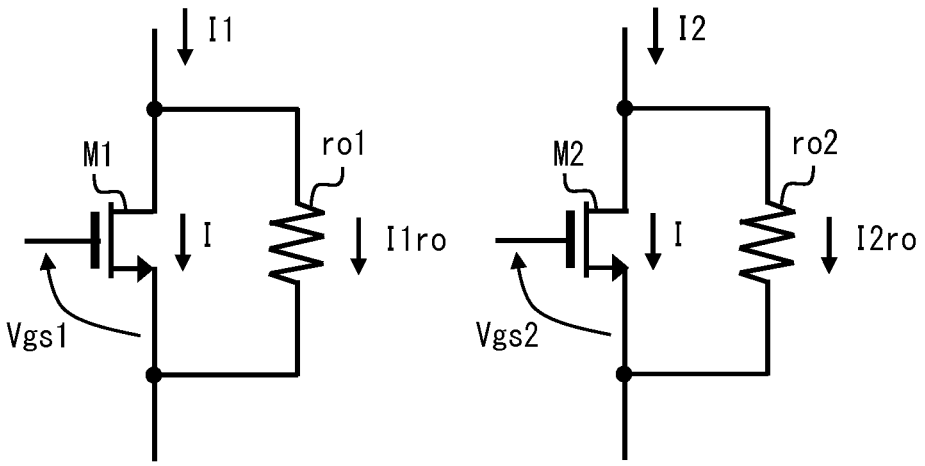
FIG. 9 shows details of MOS transistors provided on a PTAT current generation loop of the bandgap reference circuit shown in FIG. 8.

FIG. 9 shows details of the MOS transistors M1 and M2. In FIG. 9, the resistive component of a current path that is formed between the source and drain of the MOS transistor M1 by the short channel effect is represented as "ro1", and similarly, the resistive component of a current path that is formed between the source and drain of the MOS transistor M2 by the short channel effect is represented as "ro2".

Note that, of the current I1 supplied to the MOS transistor M1, a current I that flows when the square-root law is assumed flows between the source and drain of the MOS transistor M1, and a current I1*ro* flows through the resistive component rot. Further, of the current I2 supplied to the MOS transistor M2, a current I that flows when the square-root law is assumed flows between the source and drain of the MOS transistor M2, and a current I2*ro* flows through the resistive component ro2. That is, the current values I1 and I2 of the currents I1 and I2 are expressed by the below-shown Expressions (4) and (5).

[Expression 4]

$$I1=I+I1ro \tag{4}$$

[Expression 5]

$$I2=I+I2ro \tag{5}$$

When the offset voltages Vos1 and Vos2 of the operational amplifiers A1 and A2, respectively, are not taken into consideration, the voltages Vds1 and Vds2 between the sources and drains (hereinafter called "source-drain voltages Vds1 and Vds2") of the MOS transistors M1 and M2, respectively, are expressed by the below-shown Expressions (6) and (7).

[Expression 6]

$$Vds1=Vb-(V1-Vgs1) \tag{6}$$

[Expression 7]

$$Vds2-Vb-(V1-Vgs2) \tag{7}$$

On the other hand, when the offset voltages Vos1 and Vos2 of the operational amplifiers A1 and A2, respectively, are taken into consideration, the source-drain voltages Vds1_os and Vds2_os of the MOS transistors M1 and M2, respectively, are expressed by the below-shown Expressions (8) and (9).

[Expression 8]

$$Vds1_os=Vds1-Vos1 \tag{8}$$

[Expression 9]

$$Vds2_os=Vds2-Vos2 \tag{9}$$

Further, in this case, the current values I1*ro* and I2*ro* are expressed by the below-shown Expressions (10) and (11).

Note that ro represents the resistance value of each of the resistive components ro1 and ro2.

[Expression 10]

$$I1ro = \frac{Vds1 - Vos1}{ro} \tag{10}$$

[Expression 11]

$$I2ro = \frac{Vds2 - Vos2}{ro} \tag{11}$$

Note that since the sizes of the MOS transistors M1 and M2 are equal to each other, the relations "Vgs1=Vgs2=Vgs" and "Vds1=Vds2=Vds" hold. Further, based on Expressions (1), (2), (3), (4), (10) and (11), the below-shown Expression (12) holds.

[Expression 12] (12)

$$\begin{aligned} I2 &= \frac{Vbe1 - Vbe2}{R1} \\ &= \frac{Vt \cdot \ln\left(\frac{n \cdot I1}{I2}\right)}{R1} \\ &= \frac{Vt \cdot \ln\left(\frac{n\left\{I + \frac{Vds1 - Vos1}{ro}\right\}}{I + \frac{Vds2 - Vos2}{ro}}\right)}{R1} \end{aligned}$$

Note that since the relation "I2=I3" holds, the reference voltage Vbgr is expressed by the below-shown Expression (13).

[Expression 13]

$$\begin{aligned} Vbgr &= Vbe3 + R2 \cdot I2 \\ &= Vbe3 + \frac{R2}{R1}\left(Vt \cdot \ln\left(\frac{n\left\{I + \frac{Vds1 - Vos1}{ro}\right\}}{I + \frac{Vds2 - Vos2}{ro}}\right)\right) \end{aligned} \tag{13}$$

Note that in general, the MOS transistors M1 and M2 are designed so that the resistance value ro of each of the resistive components ro1 and ro2 of the current paths formed between the sources and drains of the MOS transistors M1 and M2, respectively, by the short channel effect is very high. By referring to Expression (13), it can be understood that when the resistance value ro is very high, the offset voltages Vos1 and Vos2 hardly have any effect on the reference voltage Vbgr. That is, the bandgap reference circuit 1 is not substantially affected by the offset voltages Vos1 and Vos2 and hence is able to generate an accurate reference voltage Vbgr.

Figure 10:
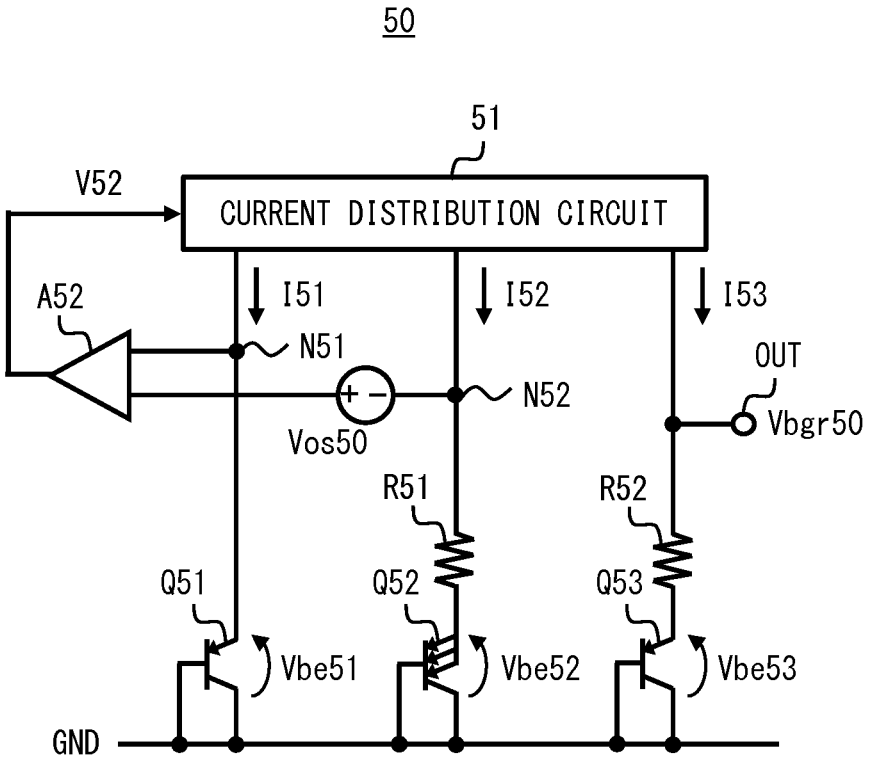
FIG. 10 is a circuit diagram showing a bandgap reference circuit according to a comparative example.

FIG. 10 is a circuit diagram showing a bandgap reference circuit 50 according to a comparative example. As shown in FIG. 10, the bandgap reference circuit 50 includes a current distribution circuit 51, an operational amplifier A52, bipolar transistors Q51 to Q53, and resistive elements R51 and R52. The current distribution circuit 51, the operational amplifier A52, the bipolar transistors Q51 to Q53, the resistive elements R51 and R52, and nodes N51 and N52 correspond to the current distribution circuit 11, the operational amplifier A2, the bipolar transistors Q1 to Q3, the resistive elements R1 and R2, and the nodes N1 and N2, respectively. Note that the operational amplifier A52 generates a control voltage V5 according to the potential difference between the nodes N51 and N52. The other configuration of the bandgap reference circuit 50 is similar to that of the bandgap reference circuit 1, and therefore its explanation is omitted.

In the bandgap reference circuit 50, a PTAT current generation loop is formed by the bipolar transistor Q51, the operational amplifier A52, the resistive element R51, and the bipolar transistor Q52. This PTAT current generation loop includes the operational amplifier A52 disposed thereon.

Firstly, the base-emitter voltages Vbe51 and Vbe52 of the bipolar transistors Q51 and Q52, respectively, are expressed by the below-shown Expressions (14) and (15).

[Expression 14]

$$Vbe51 = Vt \cdot \ln\left(\frac{I51}{Js \cdot A}\right) \tag{14}$$

[Expression 15]

$$Vbe52 = Vt \cdot \ln\left(\frac{I52}{n \cdot Js \cdot A}\right) \tag{15}$$

Further, assuming that the operational amplifier A52 is performing a normal feedback operation, the below-shown Expression (16) holds.

[Expression 16]

$$Vbe51 = Vbe52 + R51 \cdot I52 + Vos50 \tag{16}$$

In the expression, R51 represents the resistance value of the resistive element R51; I52 represents the current value of the current I52; and Vos50 represents the offset voltage of the operational amplifier A52.

Based on Expressions (14) to (16), the current I52 is expressed by the below-shown Expression (17).

[Expression 17]

$$I52 = \frac{Vt \cdot \ln(n) - Vos50}{R51} \tag{17}$$

Note that since the relation "I52=I53" holds, the reference voltage Vbgr50 is expressed by the below-shown Expression (18).

[Expression 18]

$$\begin{aligned} Vbgr50 &= Vbe53 + R52 \cdot I52 \\ &= Vbe53 + \frac{R52}{R51}(Vt \cdot \ln(n) - Vos50) \end{aligned} \tag{18}$$

From Expression (18), it can be understood that the reference voltage Vbgr50 could change due to the influence of the offset voltage Vos50. That is, the bandgap reference circuit 50 is affected by the offset voltage Vos50 and hence is not able to generate an accurate reference voltage Vbgr50.

Figure 11:
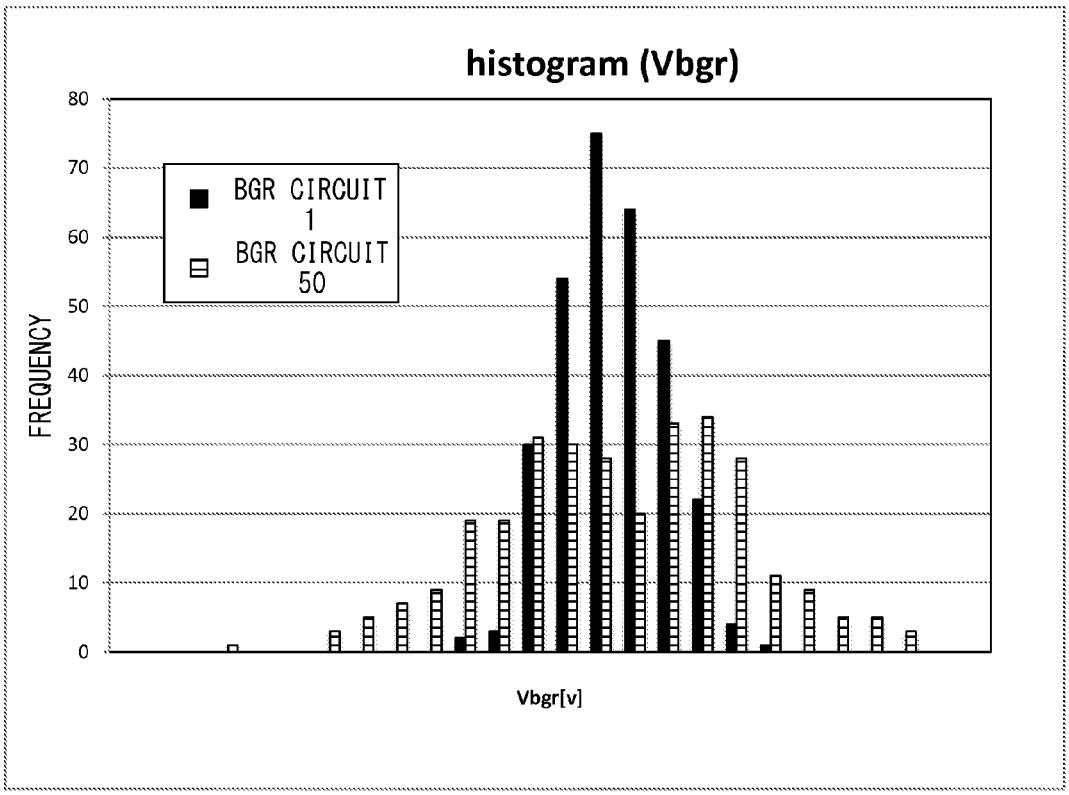
FIG. 11 is a graph showing variation characteristics of reference voltages Vbgr.

FIG. 11 is a graph showing variation characteristics of the reference voltages Vbgr and Vbgr50 of the bandgap reference circuits 1 and 50, respectively. Note that the configuration of the MOS transistors used for the input differential pair of the operational amplifier A2 of the bandgap reference circuit 50 is identical to that of the MOS transistors M1 and M2 provided in the bandgap reference circuit 1.

As shown in FIG. 11, the bandgap reference circuit 1 in which no operational amplifier is present on the PTAT current generation loop has smaller variations than those of the bandgap reference circuit 50 in which an operational amplifier is present on the PTAT current generation loop.

Although an example where the PNP type bipolar transistors Q1, Q2 and Q3 are provided is explained in this embodiment, the present invention is not limited to such examples. That is, NPN type bipolar transistors Q1*a*, Q2*a* and Q3*a* may be provided.

Figure 12:
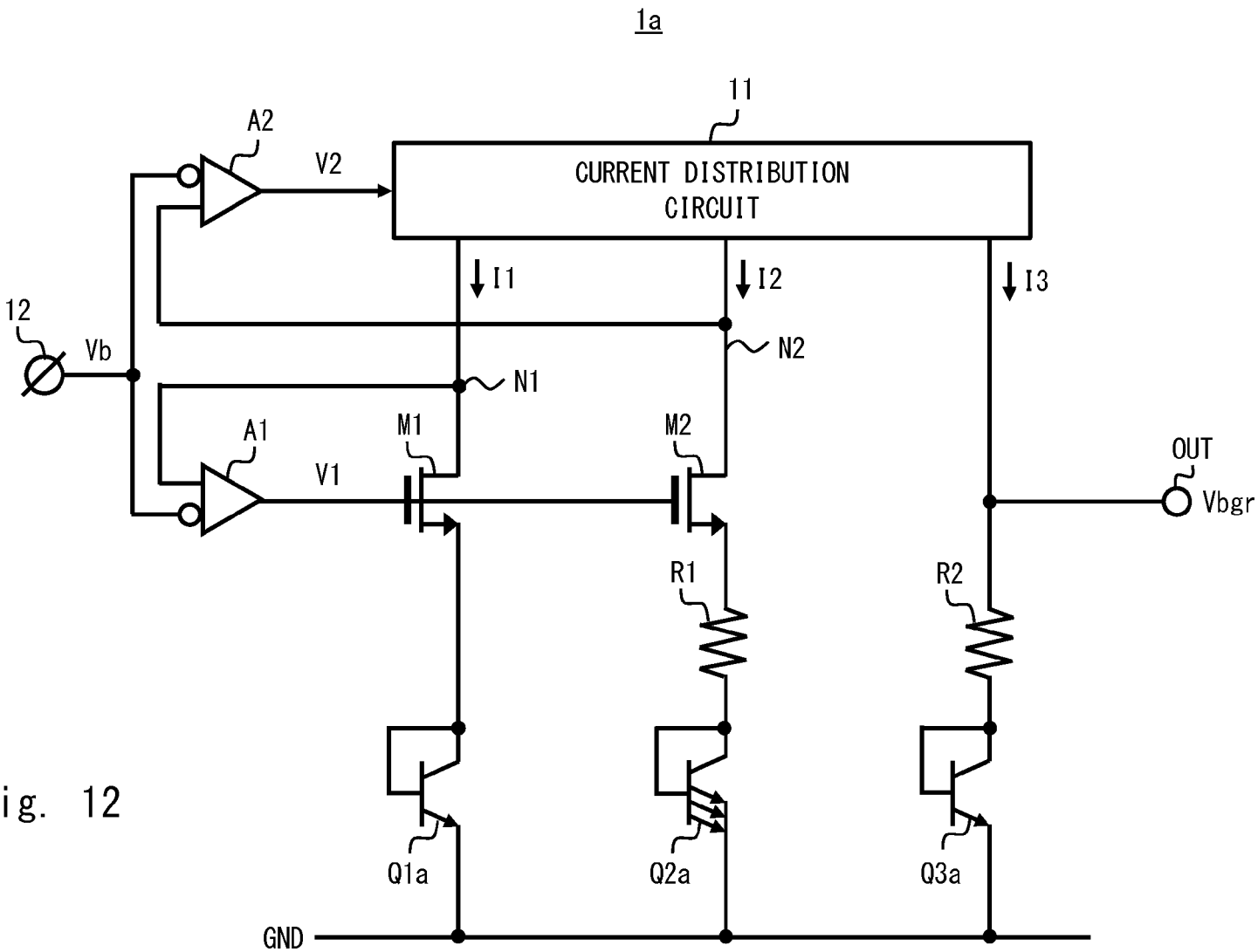
FIG. 12 is a circuit diagram showing a modified example of the bandgap reference circuit shown in FIG. 8.

FIG. 12 is a circuit diagram showing a modified example of the bandgap reference circuit 1 as a bandgap reference circuit 1*a*. As shown in FIG. 12, in comparison to the bandgap reference circuit 1, the bandgap reference circuit 1*a* includes NPN type bipolar transistors Q1*a* to Q3*a* in place of the PNP type bipolar transistors Q1 to Q3. Note that since the bandgap reference circuit 1*a* includes the NPN type bipolar transistors Q1*a* to Q3*a*, the bandgap reference circuit 1*a* needs to be formed in a triple well process. The other configuration of the bandgap reference circuit 1*a* is similar to that of the bandgap reference circuit 1, and therefore its explanation is omitted.

The bandgap reference circuit 1*a* provides advantageous effects similar to those of the bandgap reference circuit 1.

Third Embodiment

Figure 13:
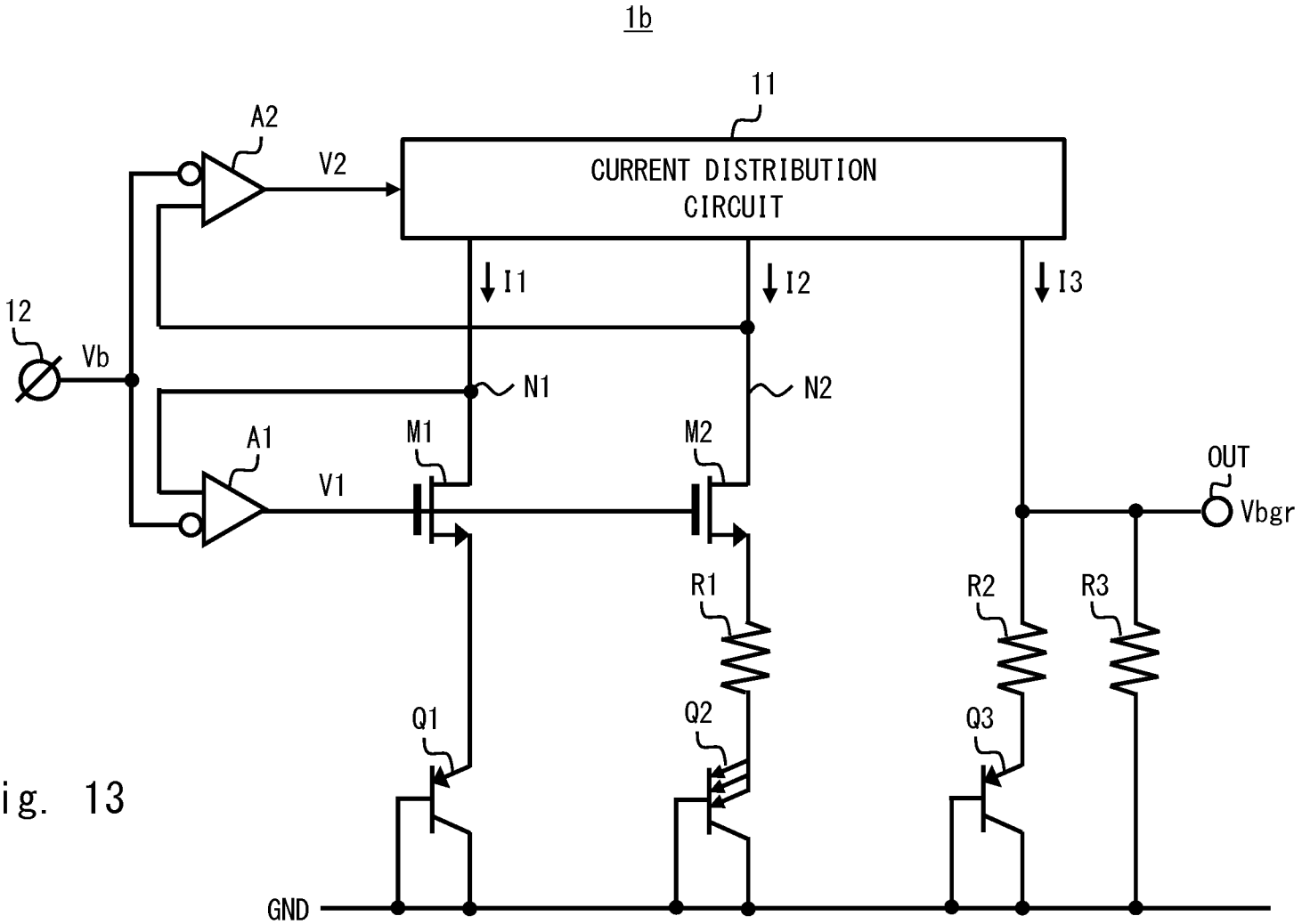
FIG. 13 is a circuit diagram showing a bandgap reference circuit according to a third embodiment.

FIG. 13 is a circuit diagram showing a bandgap reference circuit 1*b* according to a third embodiment. Note that the current generation circuit 10 is applied in the bandgap reference circuit 1*b*.

As shown in FIG. 13, in comparison to the bandgap reference circuit 1, the bandgap reference circuit 1*b* additionally includes a resistive element (third resistive element) R3 connected in parallel with the resistive element R2 and the bipolar transistor Q1. The other configuration of the bandgap reference circuit 1*b* is similar to that of the bandgap reference circuit 1, and therefore its explanation is omitted.

The bandgap reference circuit 1*b* can divide (i.e., lower) the reference voltage Vbgr from 1.2V to 0.8V, for example, by using the resistive element R3, and output the divided (i.e., lowered) reference voltage.

Fourth Embodiment

Figure 14:
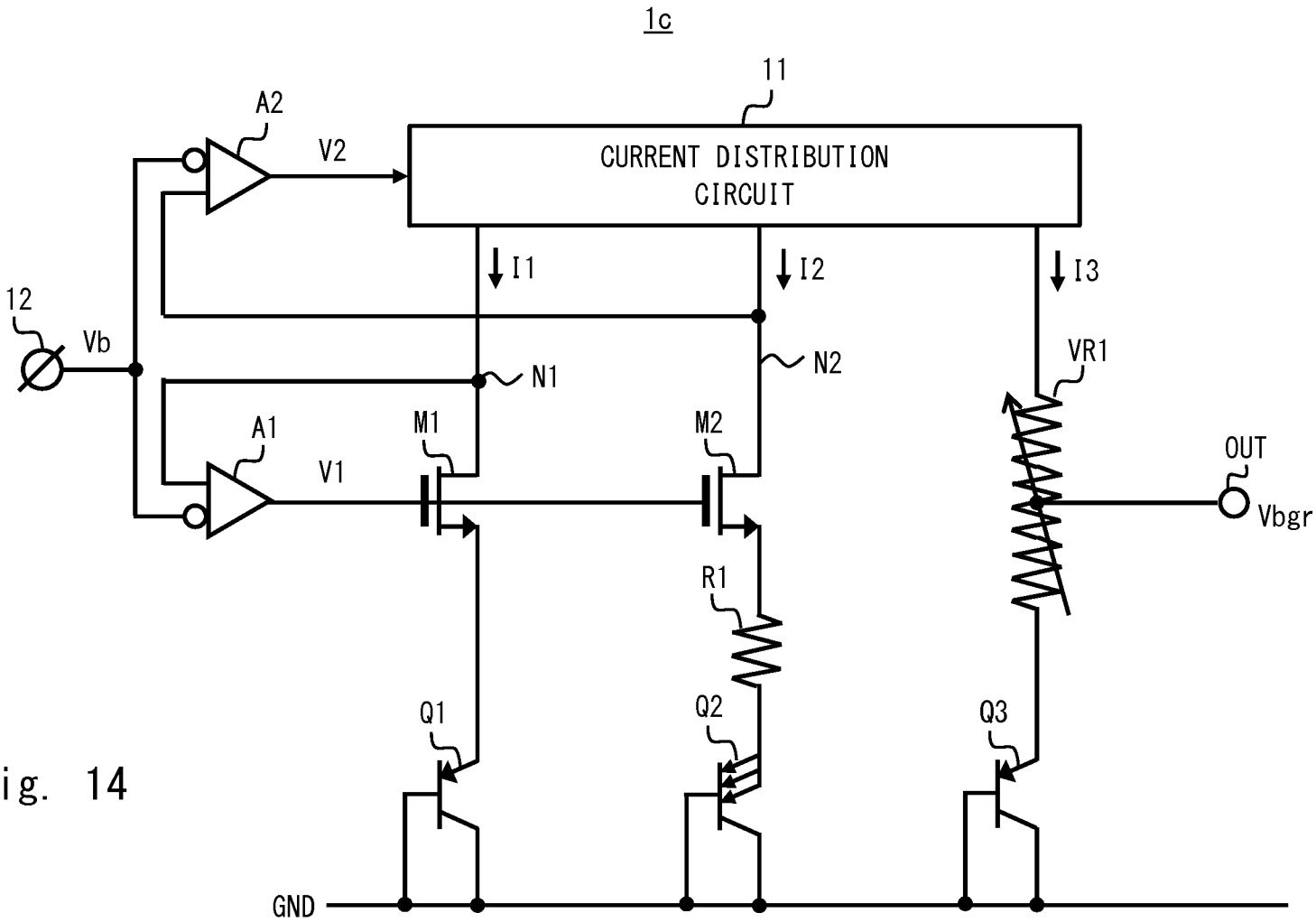
FIG. 14 is a circuit diagram showing a bandgap reference circuit according to a fourth embodiment.

FIG. 14 is a circuit diagram showing a bandgap reference circuit 1*c* according to a fourth embodiment. Note that the current generation circuit 10 is applied in the bandgap reference circuit 1*c*.

As shown in FIG. 13, in comparison to the bandgap reference circuit 1, the bandgap reference circuit 1*c* includes a variable resistance VR1 in place of the resistive element R2. The other configuration of the bandgap reference circuit 1*c* is similar to that of the bandgap reference circuit 1, and therefore its explanation is omitted.

(First Specific Example of Bandgap Reference Circuit 1*c*)

Figure 15:
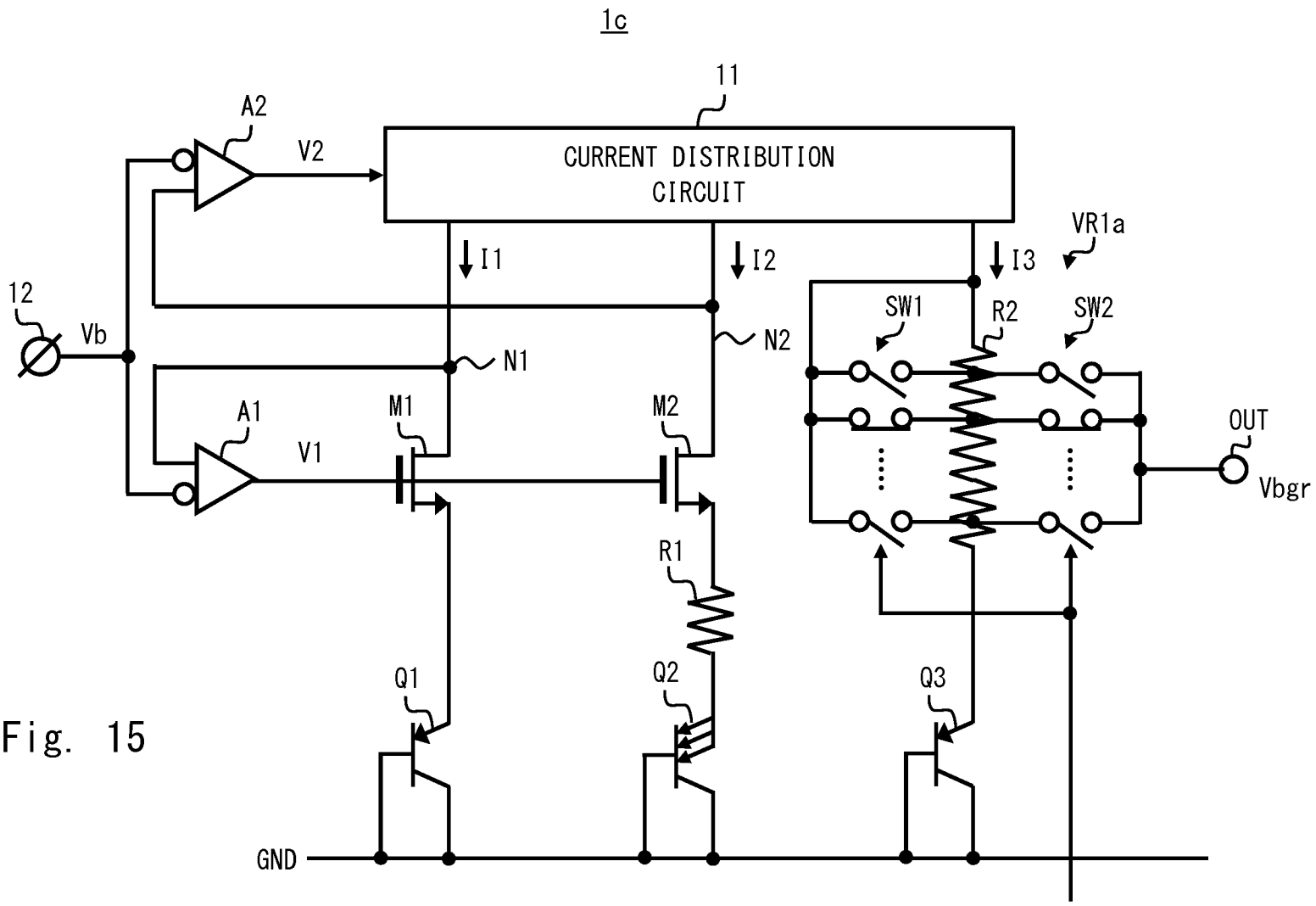
FIG. 15 is a circuit diagram showing a first specific example of the bandgap reference circuit shown in FIG. 14.

FIG. 15 is a circuit diagram showing a first specific example of the bandgap reference circuit 1*c*. In the bandgap reference circuit 1*c* shown in FIG. 15, a variable resistance VR1*a* is provided as the variable resistance VR1.

The variable resistance VR1*a* includes a resistive element R2, a plurality of switches SW1s each disposed between a respective one of a plurality of nodes on the resistive element R2 and the current distribution circuit 11, and a plurality of switches SW2s each disposed between a respective one of the plurality of nodes on the resistive element R2 and the output terminal OUT. One of the plurality of switches SW1s and one of the plurality of switches SW2s are turned on by an externally supplied control signal.

With this configuration, the variable resistance VR1*a* can change the resistance value between the output terminal OUT and the bipolar transistor Q3 by controlling the switches SW2s based on the control signal. By doing so, the bandgap reference circuit 1*c* shown in FIG. 15 can make a fine adjustment to the temperature dependence of the reference voltage Vbgr. Further, the variable resistance VR1*a* can change the resistance value between the current distribution circuit 11 and the bipolar transistor Q3 by controlling the switches SW1s based on the control signal. By doing so, the variable resistance VR1*a* can prevent the rise of the upper end voltage (the voltage on the side connected to the current distribution circuit 11) of the resistive element R2 and thereby maintain the normal operation of the current distribution circuit 11.

(Second Specific Example of Bandgap Reference Circuit 1*c*)

Figure 16:
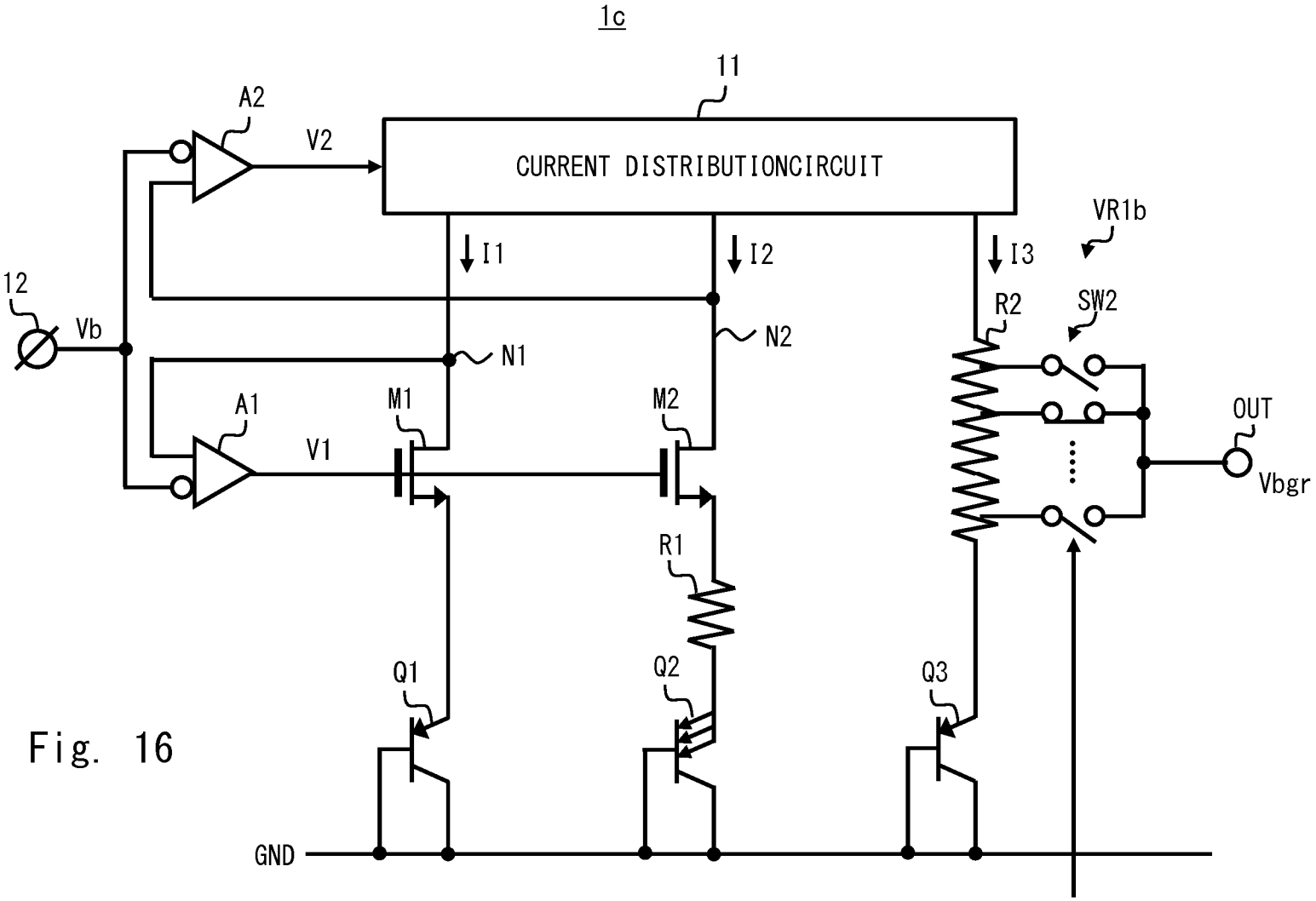
FIG. 16 is a circuit diagram showing a second specific example of the bandgap reference circuit shown in FIG. 14.

FIG. 16 is a circuit diagram showing a second specific example of the bandgap reference circuit 1*c*.

In the bandgap reference circuit 1*c* shown in FIG. 16, a variable resistance VR1*b* is provided as the variable resistance VR1.

The variable resistance VR1*b* includes a resistive element R2 and a plurality of switches SW2s each disposed between a respective one a plurality of nodes on the resistive element R2 and the output terminal OUT. One of the plurality of switches SW2s is turned on by an externally supplied control signal.

With this configuration, the variable resistance VR1*b* can change the resistance value between the output terminal OUT and the bipolar transistor Q3 by controlling the switches SW2s based on the control signal. By doing so, the bandgap reference circuit 1*c* shown in FIG. 16 can make a fine adjustment to the temperature dependence of the reference voltage Vbgr.

Fifth Embodiment

Figure 17:
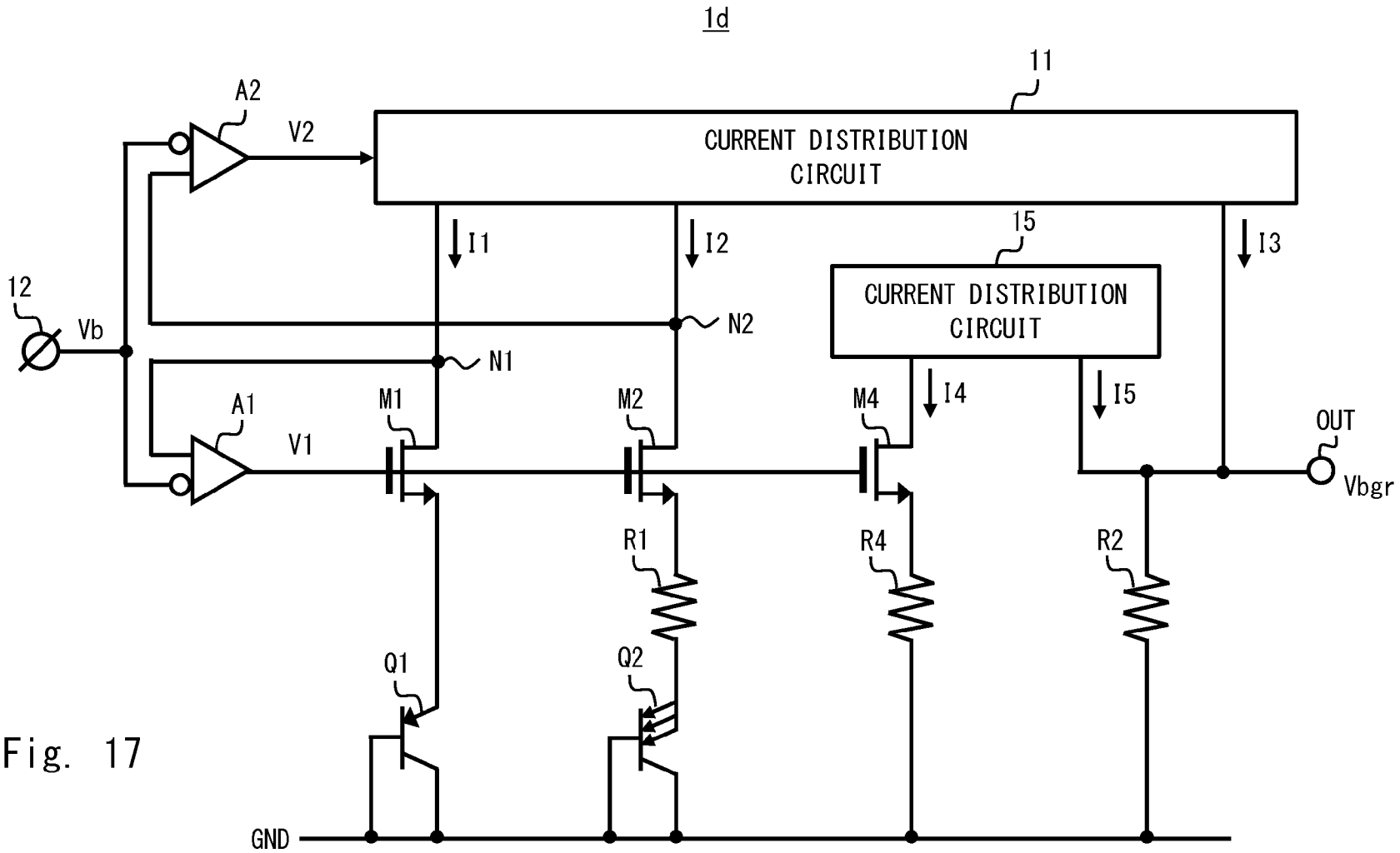
FIG. 17 is a circuit diagram showing a bandgap reference circuit according to a fifth embodiment.

FIG. 17 is a circuit diagram showing a bandgap reference circuit 1*d* according to a fifth embodiment. Note that the current generation circuit 10 is applied in the bandgap reference circuit 1*d*.

As shown in FIG. 17, in comparison to the bandgap reference circuit 1, the bandgap reference circuit 1*d* additionally includes a current distribution circuit (second current distribution circuit) 15, an N-channel type MOS transistor (third NMOS transistor) M4, and a resistive element (fourth resistive element) R4.

The source of the MOS transistor M4 is connected to one end of the resistive element R4 and the drain of the MOS transistor M4 is connected to the current distribution circuit 15. Further, the control voltage V1 output from the operational amplifier A1 is supplied to the gate of the MOS transistor M4. The other end of the resistive element R4 is connected to the ground voltage terminal GND.

The current distribution circuit 15, which is, for example, a current mirror circuit, outputs a current I4 and a current I5 in proportion to the current I4. The current I4 flows between the source and drain of the MOS transistor M4 and through the resistive element R4. Further, the current I5 flows through the resistive element R2. That is, both the current I3 output from the current distribution circuit 11 and the current I5 output from the current distribution circuit 15 flow through the resistive element R2.

Further, the bandgap reference circuit 1*d* externally outputs a voltage at a node on the current path extending from the current distribution circuits 11 and 15 to the resistive element R2 as a reference voltage Vbgr from its output terminal OUT.

Note that based on the current path that starts from the ground voltage terminal GND, passes through the bipolar transistor Q1, the MOS transistor M1, the MOS transistor M4, and the resistive element R4, and reaches the ground voltage terminal GND again, the below-shown Expression (19) holds.

[Expression 19]

$$Vbe1+Vgs1=Vgs4+Vr4 \quad (19)$$

In the expression, Vgs4 represents the gate-source voltage of the MOS transistor M4, and Vr4 represents the voltage generated across the resistive element R4.

From Expression (19), it appears that the relation "Vbe1=Vr4" holds if the sizes of the MOS transistors M1 and M4 are equal to each other. However, in reality, since the currents I1 and I4, which flow between the sources and drains of the MOS transistors M1 and M4, respectively, are different from each other, the values Vbe1 and Vr4 are different from each other.

Note that when the difference between the voltages Vgs1 and Vgs4 is expressed as "AVgs=Vgs1−Vgs4", the below-shown Expression (20) holds.

[Expression 20]

$$Vr4=\Delta Vgs+Vbe1 \quad (20)$$

In the primary approximation (or first-order approximation), the voltage Vr4 has negative temperature dependence. Therefore, the current I4, which is determined by the resistance value R4 of the resistive element R4 and the voltage value Vr4, (and the current I5 in proportion to the current I4) has negative temperature dependence. Meanwhile, as described above, the current I2 (and the current I3 in proportion to the current I2) has positive temperature dependence.

The bandgap reference circuit 1*d* can generate a constant reference voltage Vbgr irrespective of its temperature by making both the current I3 having positive temperature dependence output from the current distribution circuit 11 and the current I5 having negative temperature dependence output from the current distribution circuit 15 flow through the resistive element R2.

Note that it has been known that in general, the base-emitter voltage of a bipolar transistor includes a second-order term. Therefore, for example, when only the configuration in which the negative temperature dependence and the position temperature dependence are cancelled out each other by using the differential voltage ΔVbe having positive temperature dependence and the base-emitter voltage Vbe3 having negative temperature dependence is employed as in the case of the bandgap reference circuit 1, the second-order term of the base-emitter voltage Vbe3 remains. As a result, there is a possibility that the reference voltage Vbgr is unstable for temperature changes. It has been known that it is desirable to include a signal having a third-order characteristic in the reference voltage Vbgr in order to solve this instability.

In contrast to this, in the bandgap reference circuit 1*d*, the currents I4 and I5 are not a function of the voltage Vbe1 alone but are a function of the voltage Vbe1 and the differential voltage ΔVbe (see Expression (20)). It has been confirmed that these currents I4 and I5 include a third-order term based on simulations and the like. Therefore, since the reference voltage Vbgr includes a signal having a third-order characteristic, the reference voltage Vbgr is stable even when the temperature changes.

Figure 18:
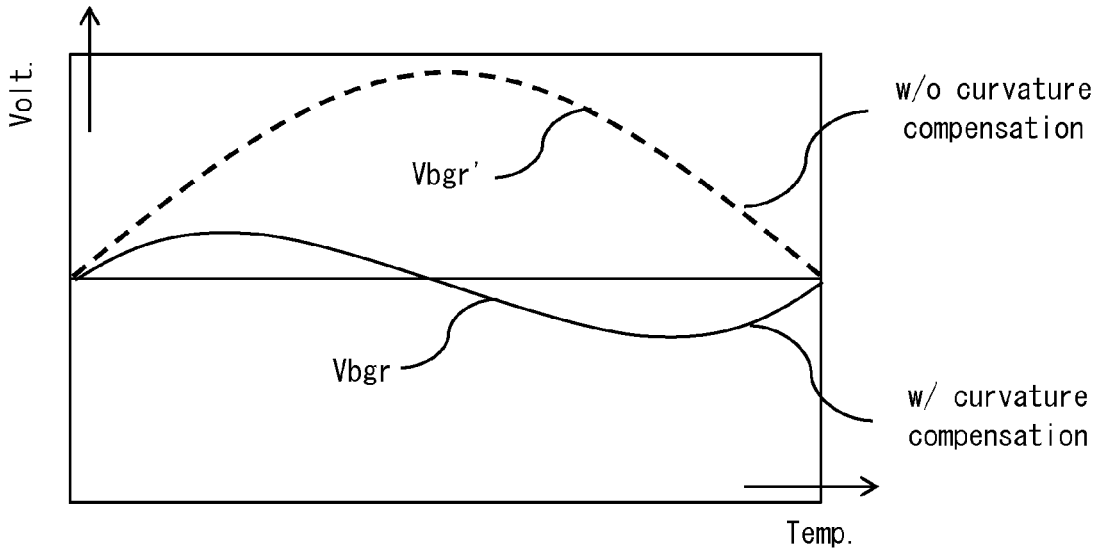
FIG. 18 is a graph showing characteristics of a reference voltage Vbgr before and after secondary characteristic compensation.

FIG. 18 is a graph showing characteristics of the reference voltage Vbgr before and after secondary characteristic compensation. In the figure, the broken line represents the reference voltage Vbgr before the secondary characteristic compensation and the solid line represents the reference voltage Vbgr after the secondary characteristic compensation.

As shown in FIG. 18, while the reference voltage Vbgr before the secondary characteristic compensation is relatively unstable for temperature changes, the reference voltage Vbgr after the secondary characteristic compensation is relatively stable even when the temperature changes.

Sixth Embodiment

Figure 19:
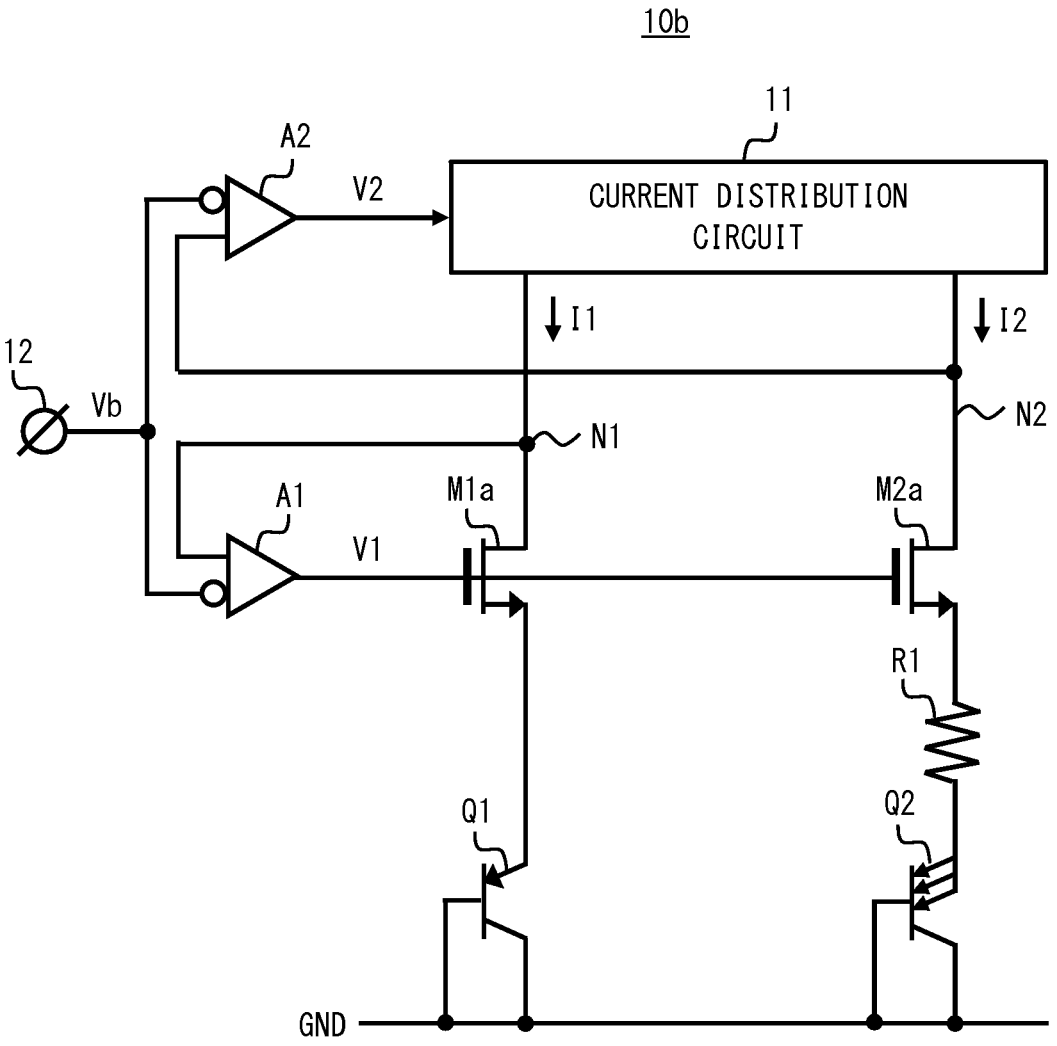
FIG. 19 is a circuit diagram showing a current generation circuit according to a sixth embodiment.

FIG. 19 is a circuit diagram showing a current generation circuit 10*b* according to a sixth embodiment. In comparison to the current generation circuit 10, the current generation circuit 10*b* includes depletion type MOS transistors M1*a* and M2*a* in place of the enhancement type MOS transistors M1 and M2. The other configuration of the current generation circuit 10*b* is similar to that of the current generation circuit 10, and therefore its explanation is omitted.

The current generation circuit 10*b* can lower the gate voltage of the MOS transistors M1*a* and M2*a*. By doing so, the requirement on the output voltage range for the operational amplifier A1 is relaxed, thus making it possible to drive the current generation circuit 10*b* at a lower voltage.

As described above, the current generation circuit 10*b* can be operated at a lower voltage, while providing advantageous effects similar to those of the current generation circuit 10.

Although an example where the depletion type MOS transistors M1*a* and M2*a* are provided in place of the enhancement type MOS transistors M1 and M2 is explained in this embodiment, the present invention is not limited to such examples. That is, native type MOS transistors M1*a* and M2*a* may be provided.

Further, in the current generation circuit 10*b*, the PNP type bipolar transistors Q1 and Q2 may be replaced by NPN type bipolar transistors Q1*a* and Q2*a* as in the case of the example shown in FIG. 7.

(Bandgap Reference Circuit 1*e* in which Current Generation Circuit 10*b* is Applied)

Figure 20:
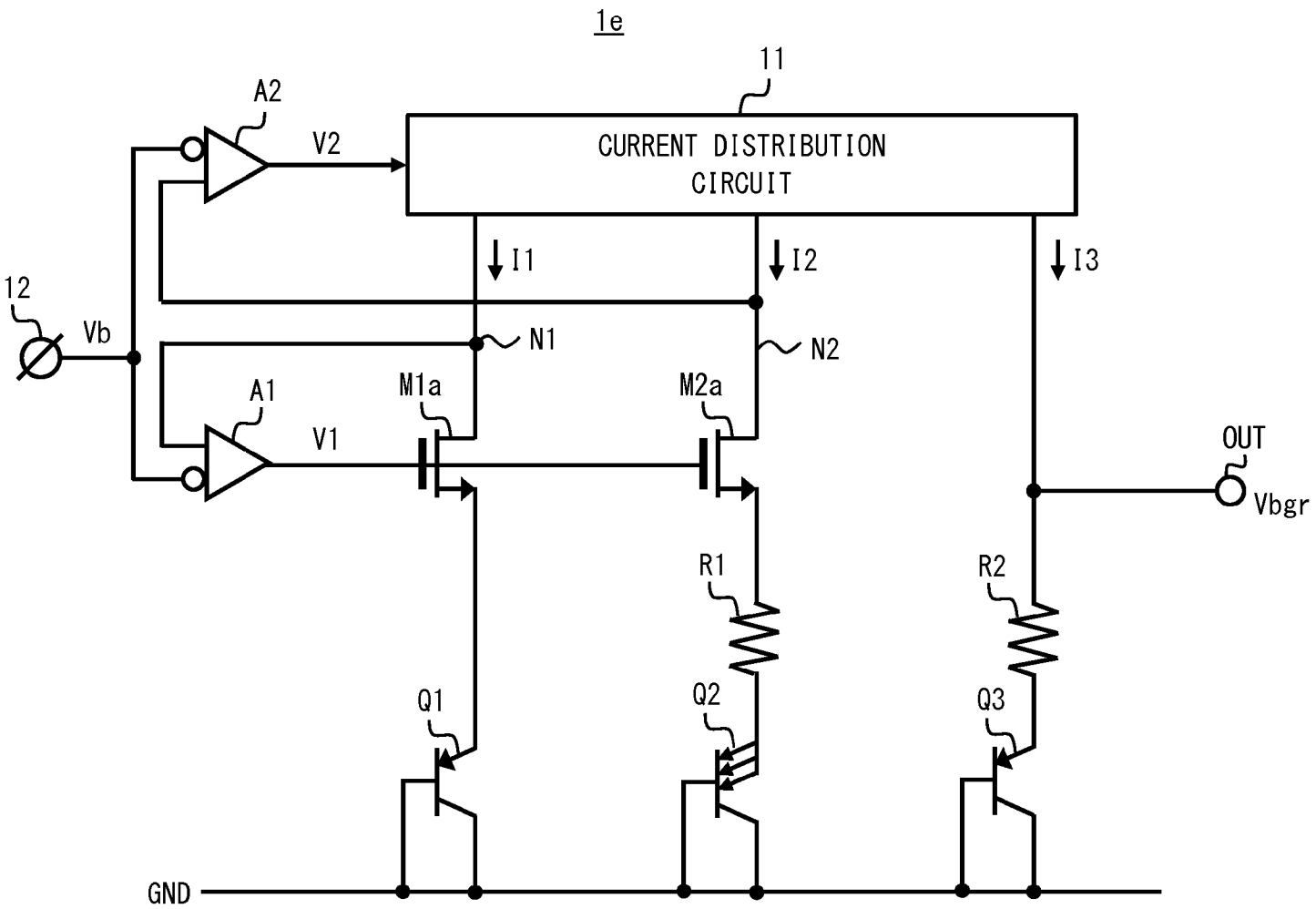
FIG. 20 is a circuit diagram showing a bandgap reference circuit in which the current generation circuit shown in FIG. 19 is applied.

FIG. 20 is a circuit diagram showing a bandgap reference circuit 1*e* in which the current generation circuit 10*b* is applied.

As shown in FIG. 20, the bandgap reference circuit 1*e* further includes a resistive element R2 and a bipolar transistor Q3 in addition to the configuration of the current generation circuit 10*b*. That is, the bandgap reference circuit 1*e* is obtained by replacing the current generation circuit 10 by the current generation circuit 10*b* in the bandgap reference circuit 1.

The bandgap reference circuit 1*e* provides advantageous effects similar to those of the bandgap reference circuit 1. Further, the bandgap reference circuit 1*e* can be operated at a low voltage by using the depletion type or native type MOS transistors M1*a* and M2*a*.

Note that the bandgap reference circuit 1*e* may include a resistive element R3 connected in parallel with the resistive element R2 and the bipolar transistor Q3 as in the case of the example shown in FIG. 13, and include a variable resistance VR1 in place of the resistive element R2 as in the case of the example shown in FIG. 14. Further, the bandgap reference circuit 1*e* may further include a current distribution circuit 15, a MOS transistor M4, and a resistive element R4 as in the case of the example shown in FIG. 17.

Further, the bandgap reference circuit 1*e* may include NPN type bipolar transistors Q1*a*, Q2*a* and Q3*a* in place of the PNP type bipolar transistors Q1, Q2 and Q3 as in the case of the example shown in FIG. 12.

Seventh Embodiment

Figure 21:
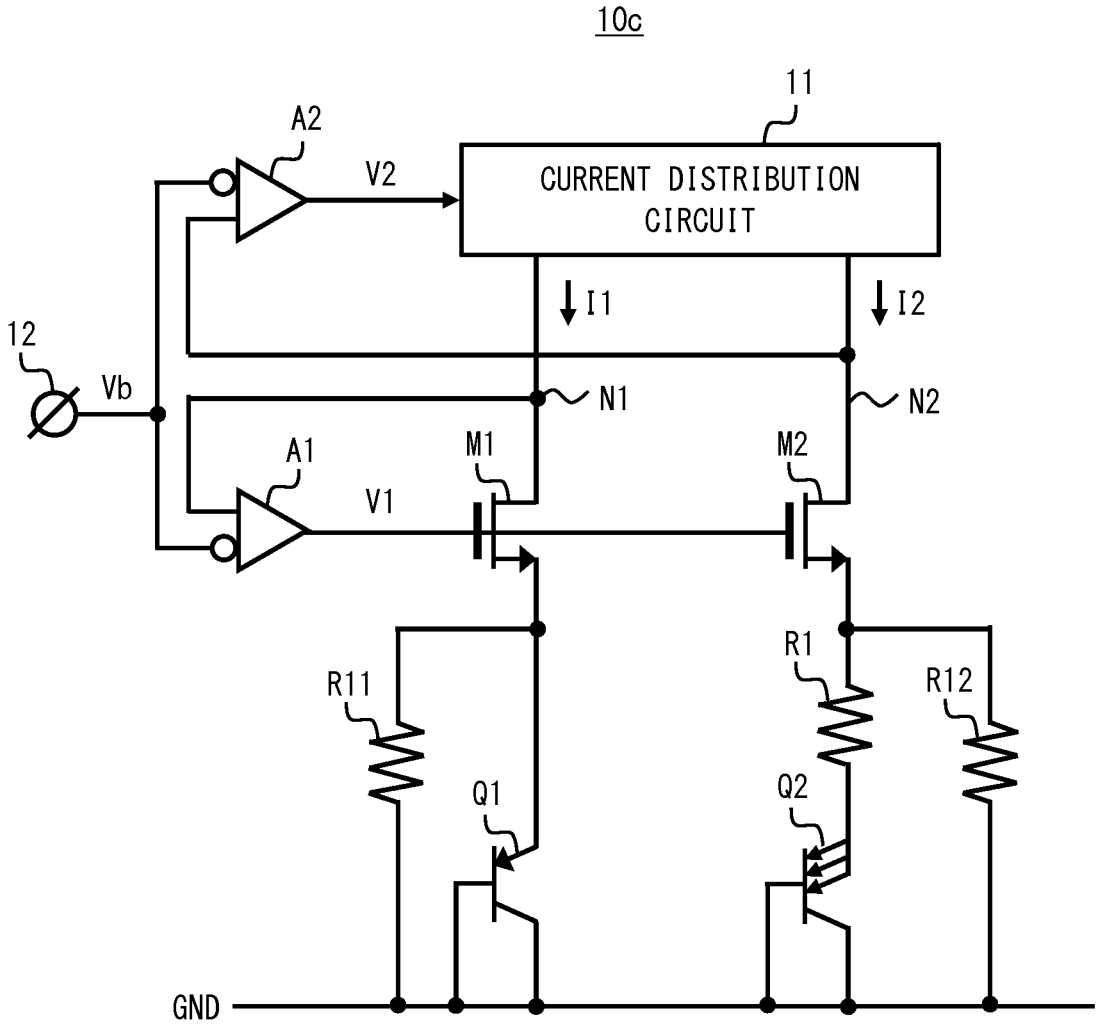
FIG. 21 is a circuit diagram showing a current generation circuit according to a seventh embodiment.

FIG. 21 is a circuit diagram showing a current generation circuit 10*c* according to a seventh embodiment. In comparison to the current generation circuit 10, the current generation circuit 10*c* additionally includes resistive elements (supplemental resistive elements) R11 and R12 between the collectors and emitters of the bipolar transistors Q1 and Q2, respectively. The other configuration of the current generation circuit 10*c* is similar to that of the current generation circuit 10, and therefore its explanation is omitted.

By additionally including the resistive elements R11 and R12 between the collectors and emitters of the bipolar transistors Q1 and Q2, respectively, the current generation circuit 10*c* can lower the level of the reference voltage Vbgr, for example, from 1.2V to 0.8V. Further, since currents having negative temperature dependence flow through the resistive elements R11 and R12 and currents having positive temperature dependence flow through the bipolar transistors Q1 and Q2, the current generation circuit 10 can consequently generate a constant current I2 irrespective of its temperature.

As described above, the current generation circuit 10*c* can accurately generate the constant current I2 irrespective of its temperature.

In the current generation circuit 10*b*, the PNP type bipolar transistors Q1 and Q2 may be replaced by NPN type bipolar transistors Q1*a* and Q2*a* as in the case of the example shown in FIG. 7.

(Bandgap Reference Circuit if in which Current Generation Circuit 10*c* is Applied)

Figure 22:
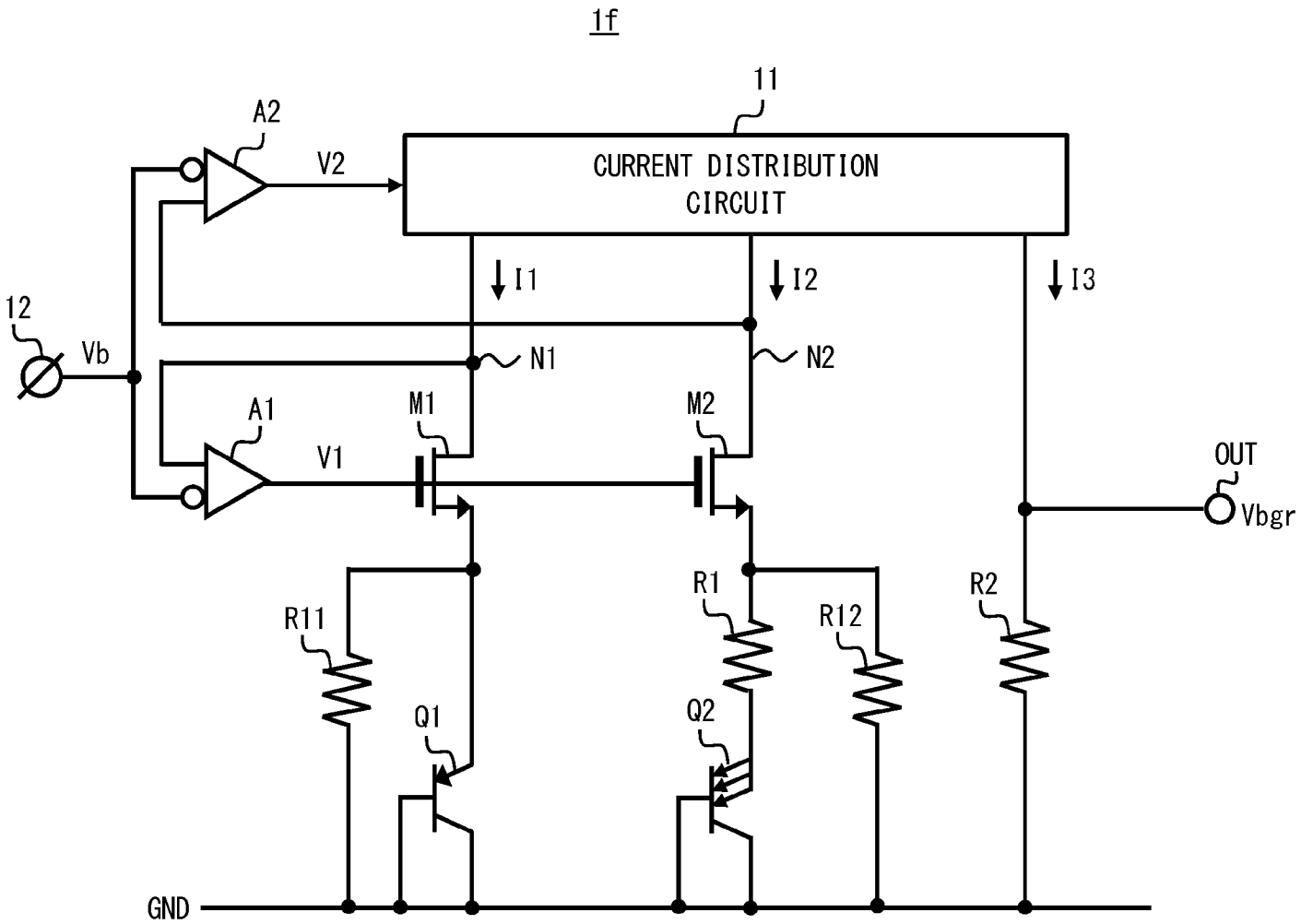
FIG. 22 is a circuit diagram showing a bandgap reference circuit in which the current generation circuit shown in FIG. 21 is applied.

FIG. 22 is a circuit diagram showing a bandgap reference circuit if in which the current generation circuit 10*c* is applied.

As shown in FIG. 22, the bandgap reference circuit if further includes a resistive element R2 in addition to the configuration of the current generation circuit 10*c*. That is, the bandgap reference circuit if is obtained by replacing the current generation circuit 10 by the current generation circuit 10*c* and removing the bipolar transistor Q3 in the bandgap reference circuit 1. Note that the bipolar transistor Q3 is removed because since the current generation circuit 10*c* generates the constant current I2 irrespective its temperature, there is no need to adjust the temperature dependence of the reference voltage Vbgr by using the bipolar transistor Q3.

The bandgap reference circuit if provides advantageous effects similar to those of the bandgap reference circuit 1.

Note that the bandgap reference circuit if may include a resistive element R3 connected in parallel with the resistive element R2, and include a variable resistance VR1 in place of the resistive element R2. Further, the bandgap reference circuit if may further include a current distribution circuit 15, a MOS transistor M4, and a resistive element R4.

Further, the bandgap reference circuit if may include NPN type bipolar transistors Q1*a* and Q2*a* in place of the PNP type bipolar transistors Q1 and Q2.

Eighth Embodiment

Figure 23:
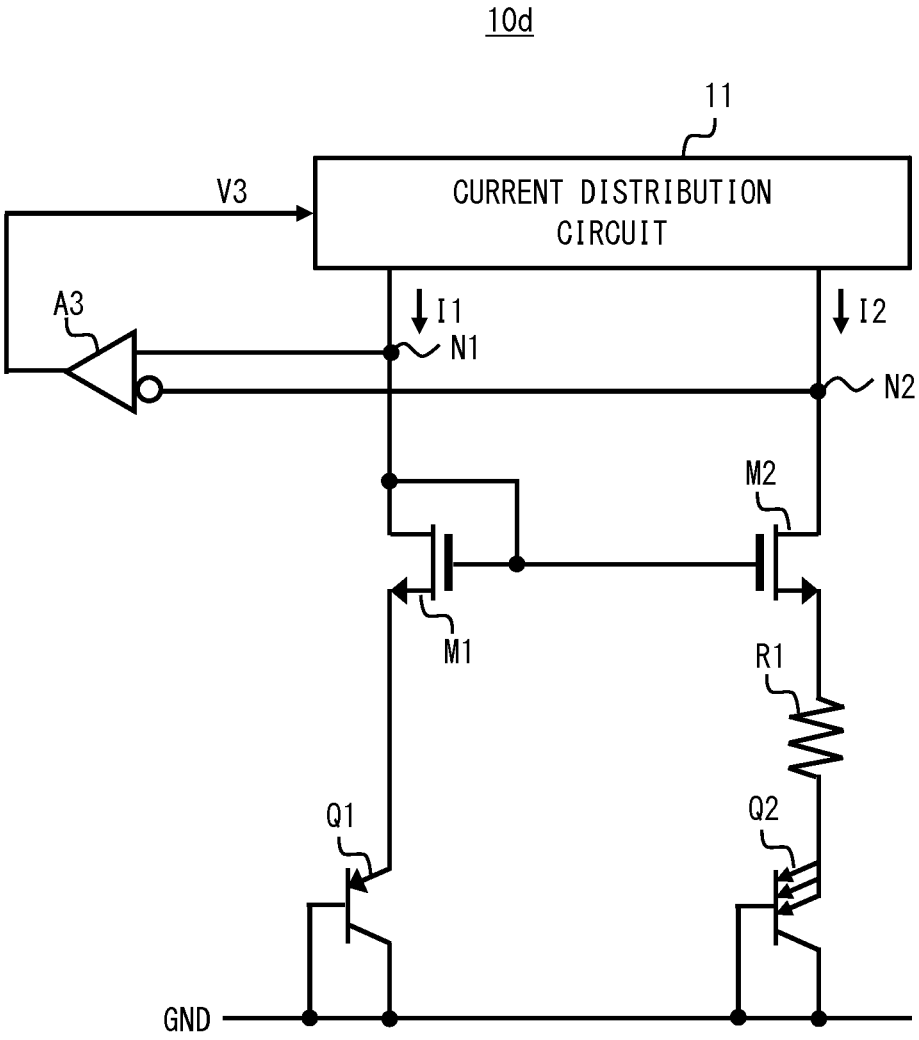
FIG. 23 is a circuit diagram showing a current generation circuit according to an eighth embodiment.

FIG. 23 is a circuit diagram showing a current generation circuit 10*d* according to an eighth embodiment. As shown in FIG. 23, the current generation circuit 10*d* includes a current distribution circuit 11, N-channel type MOS transistors M1 and M2, PNP type bipolar transistors Q1 and Q2, a resistive element R1, and an operational amplifier A3.

The base and collector of the bipolar transistor Q1 are both connected to the ground voltage terminal GND. The base and collector of the bipolar transistor Q2 are both connected to the ground voltage terminal GND.

The source of the MOS transistor M1 is connected to the emitter of the bipolar transistor Q1 and the drain and gate of the MOS transistor M1 are connected to a node N1. That is, the MOS transistor M1 is a diode-connected transistor. The source of the MOS transistor M2 is connected to one end of the resistive element R1 and the drain of the MOS transistor M2 is connected to a node N2. Further, the gate of the MOS transistor M2 is connected to the drain and gate of the MOS transistor M1. Further, the other end of the resistive element R1 is connected to the emitter of the bipolar transistor Q2.

The operational amplifier A3 has, for example, a function equivalent to that of the operational amplifier A1 or A2, and outputs a control voltage V3 according to the potential difference between the nodes N1 and N2. The current distribution circuit 11 outputs a current I1 corresponding to the control voltage V3 output from the operational amplifier A3 and a current I2 in proportion to the current I1 to the nodes N1 and N2, respectively.

The gate potential of the MOS transistors M1 and M2 (i.e., the potential at the node N1) has a value expressed as "Vbe1+Vgs1". Note that since a depletion type MOS transistor and a native type MOS transistor cannot be diode-connected, the MOS transistors M1 and M2 have to be enhancement type MOS transistors.

With this configuration, the current generation circuit 10*d* provides advantageous effects similar to those of the current generation circuit 10. Further, in comparison to the current generation circuit 10, the current generation circuit 10*d* can reduce the number of operational amplifiers by one and thereby reduce the circuit size.

In the current generation circuit 10*d*, the PNP type bipolar transistors Q1 and Q2 may be replaced by NPN type bipolar transistors Q1*a* and Q2*a* as in the case of the example shown in FIG. 7.

(Bandgap Reference Circuit 1*g* in which Current Generation Circuit 10*d* is Applied)

Figure 24:
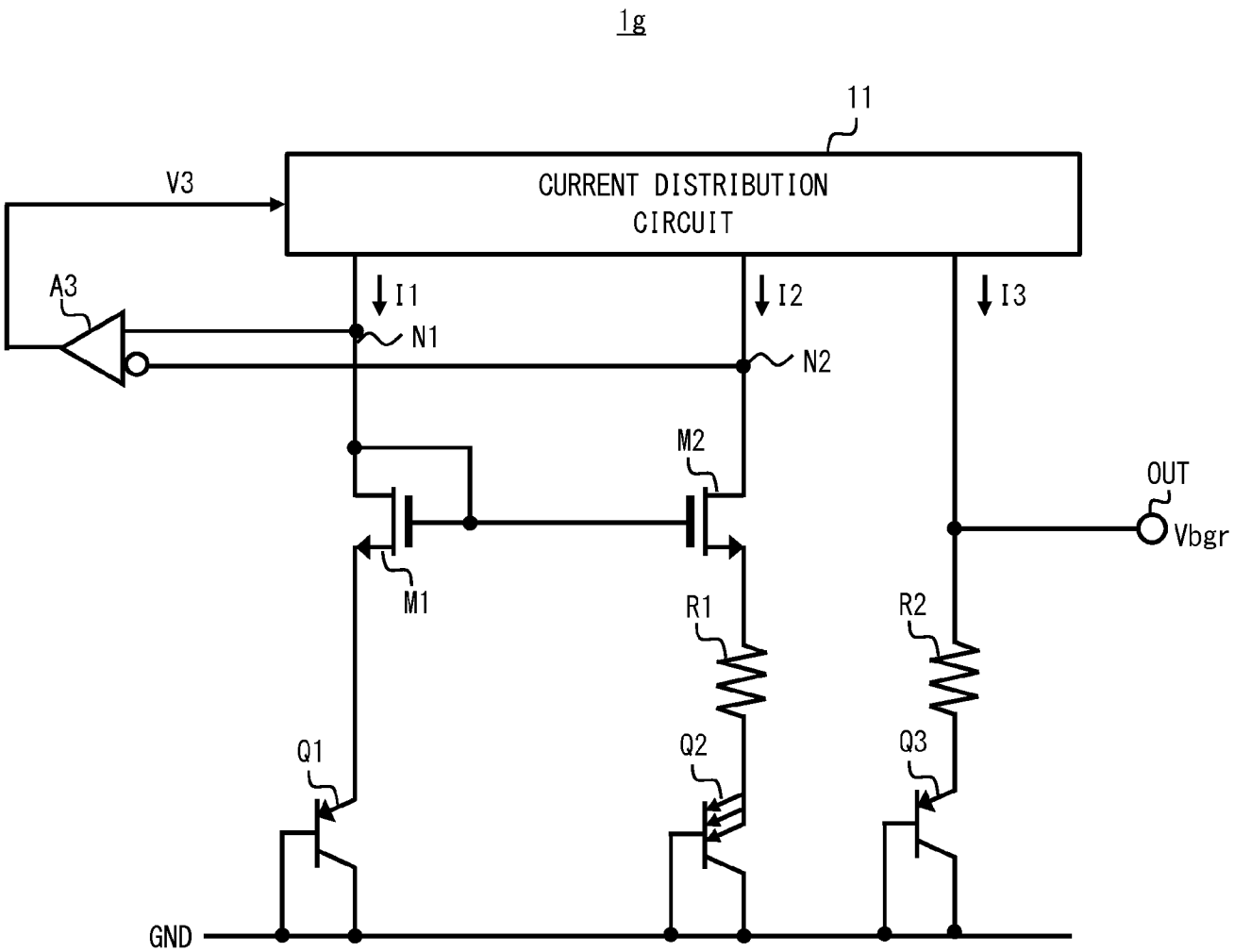
FIG. 24 is a circuit diagram showing a bandgap reference circuit in which the current generation circuit shown in FIG. 23 is applied.

FIG. 24 is a circuit diagram showing a bandgap reference circuit 1*g* in which the current generation circuit 10*d* is applied.

As shown in FIG. 24, the bandgap reference circuit 1*g* further includes a resistive element R2 and a bipolar transistor Q3 in addition to the configuration of the current generation circuit 10*d*. That is, the bandgap reference circuit 1*g* is obtained by replacing the current generation circuit 10 by the current generation circuit 10*d* in the bandgap reference circuit 1.

The bandgap reference circuit 1*g* provides advantageous effects similar to those of the bandgap reference circuit 1.

Further, since the bandgap reference circuit 1*g* can reduce the number of operational amplifiers by one, it can reduce the circuit size.

Note that the bandgap reference circuit 1*g* may include a resistive element R3 connected in parallel with the resistive element R2 and the bipolar transistor Q3 as in the case of the example shown in FIG. 13, and include a variable resistance VR1 in place of the resistive element R2 as in the case of the example shown in FIG. 14. Further, the bandgap reference circuit 1*g* may further include a current distribution circuit 15, a MOS transistor M4, and a resistive element R4 as in the case of the example shown in FIG. 17.

Further, the bandgap reference circuit 1*g* may include NPN type bipolar transistors Q1*a*, Q2*a* and Q3*a* in place of the PNP type bipolar transistors Q1, Q2 and Q3 as in the case of the example shown in FIG. 12.

Note that the characteristic features of the current generation circuits 10*b*, 10*c* and 10*d* may be combined with one another. However, the MOS transistors M1 and M2 used in the current generation circuit 10*d* have to be enhancement type MOS transistors.

Ninth Embodiment

Figure 25:
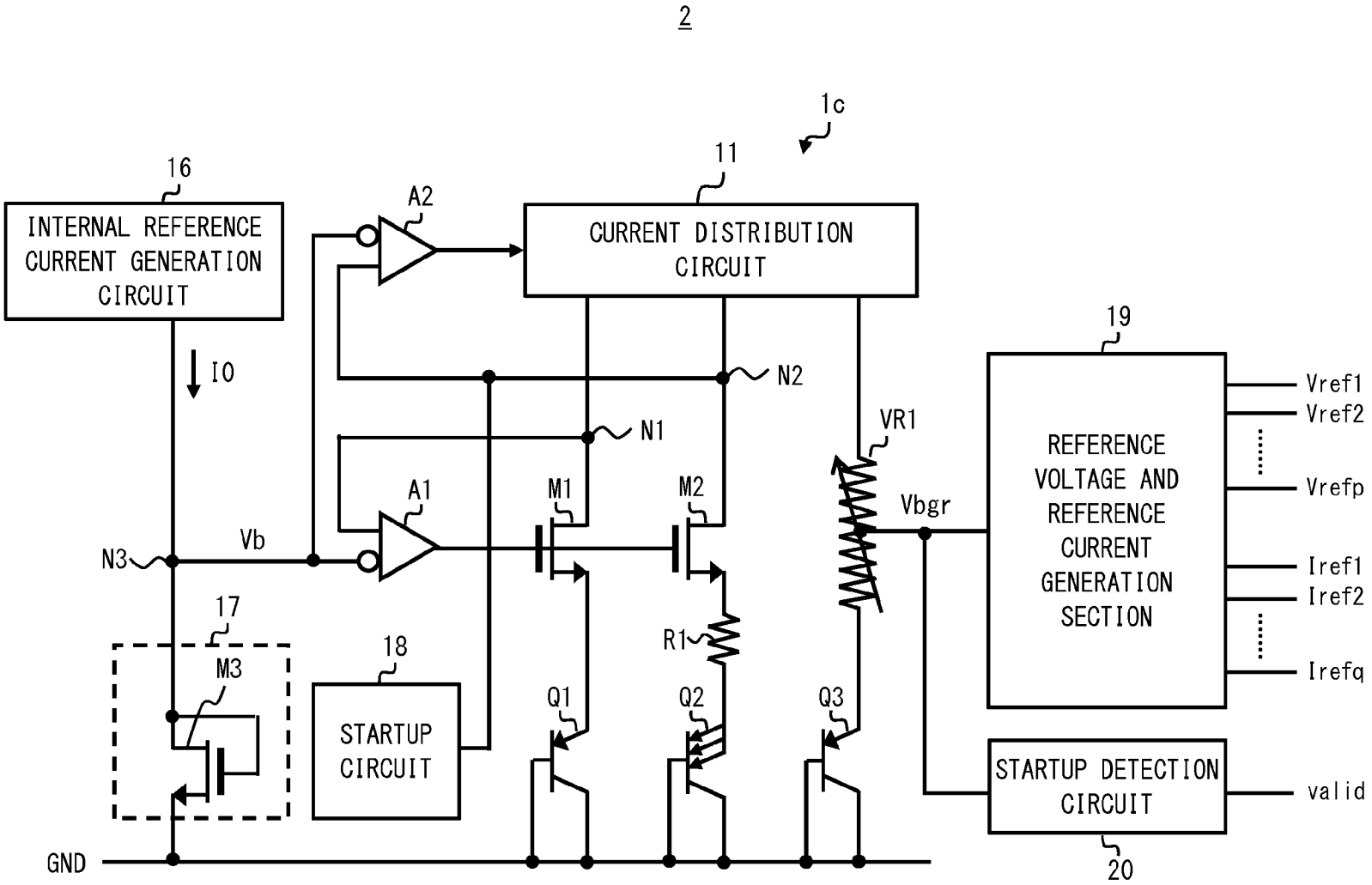
FIG. 25 is a circuit diagram showing a reference voltage and reference current generation circuit according to a ninth embodiment.

FIG. 25 shows a reference voltage and reference current generation circuit 2 according to a ninth embodiment. In the following explanation, an example where the bandgap reference circuit 1*c* is applied in the reference voltage and reference current generation circuit 2 is explained. However, needless to say, any of the above-described other bandgap reference circuits may be applied.

As shown in FIG. 25, the reference voltage and reference current generation circuit 2 includes a bandgap reference circuit 1*c*, an internal reference current generation circuit 16, a bias voltage generation circuit 17, a startup circuit 18, a reference voltage and reference current generation section (reference voltage current generation section) 19, and a startup detection circuit 20. The internal reference current generation circuit 16 and the bias voltage generation circuit 17 forms a reference bias source 12.

The internal reference current generation circuit 16 generates a reference current I0 and outputs the generated reference current I0 to a node N3. The bias voltage generation circuit 17 generates a reference bias voltage Vb based on the reference current I0 supplied through the node N3 and the resistive component of the bias voltage generation circuit 17 itself.

(Details of Internal Reference Current Generation Circuit 16)

Figure 26:
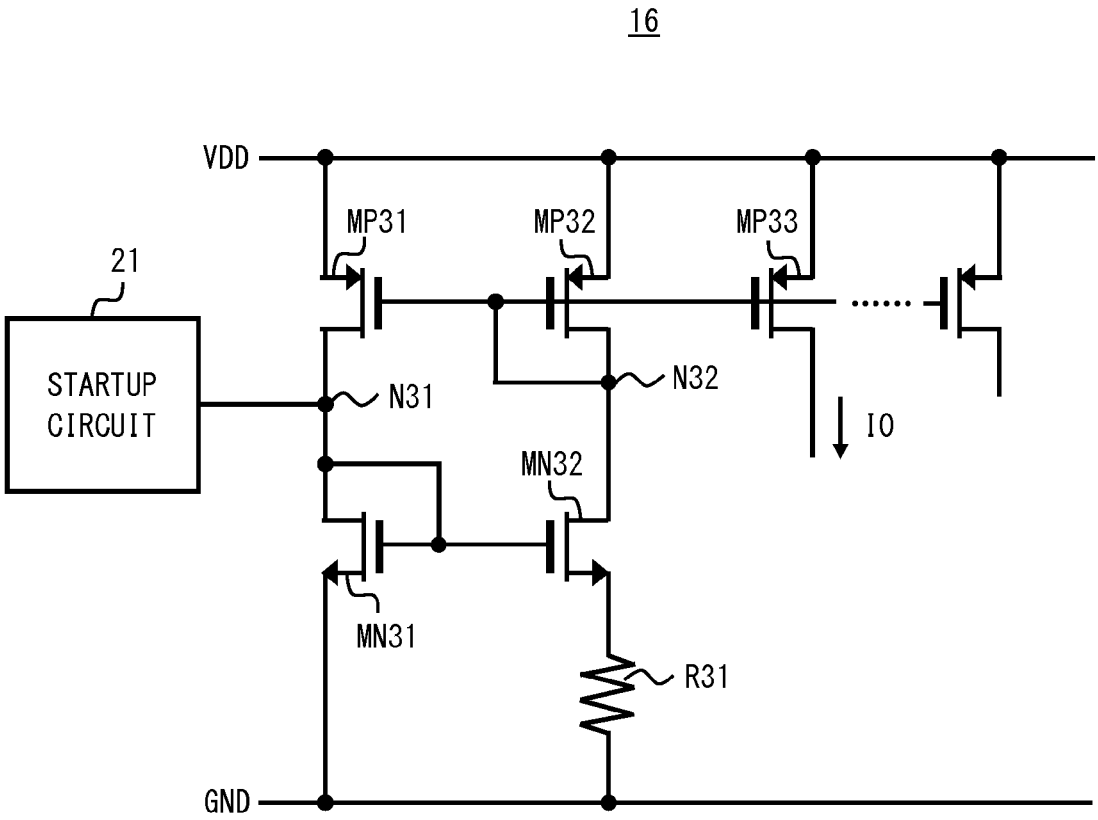
FIG. 26 shows an internal reference current generation circuit provided in the reference voltage and reference current generation circuit shown in FIG. 25.

FIG. 26 is a circuit diagram showing details of the internal reference current generation circuit 16.

As shown in FIG. 26, the internal reference current generation circuit 16 includes a startup circuit 21, P-channel type MOS transistors MP31 to MP33, N-channel type MOS transistors MN31 and MN32, and a resistive element R31.

The source of the MOS transistor MP31 is connected to the power supply voltage terminal VDD, and the drain and gate of the MOS transistor MP31 are connected to nodes N31 and N32, respectively. The source of the MOS transistor MP32 is connected to the power supply voltage terminal VDD, and the drain and gate of the MOS transistor MP32 are connected to the node N32. The source of the MOS transistor MN31 is connected to the ground voltage terminal GND, and the drain and gate of the MOS transistor MN31 are connected to the node N31. The source of the MOS transistor MN32 is connected to one end of the resistive element R31, and the drain and gate of the MOS transistor MN32 are connected to the nodes N32 and N31, respectively. The other end of the resistive element R31 is connected to the ground voltage terminal GND. The source of the MOS transistor MP33 is connected to the power supply voltage terminal VDD, and the drain of the MOS transistor MP33 is connected to the output terminal of the internal reference current generation circuit 16. Further, the gate of the MOS transistor MP33 is connected to the node N32. Further, the output of the startup circuit 21 is connected to the node N31. Note that the startup circuit 21 supplies a startup current to the node N31 and thereby stabilizes the reference current I0 when the supply of the power supply voltage is started.

With this configuration, the internal reference current generation circuit 16 can generate a stable reference current I0. Note that it is possible to generate a plurality of reference currents I0 having different current values by providing the internal reference current generation circuit 16 with a plurality of MOS transistors MP33.

Here, FIG. 25 is referred to again. The bias voltage generation circuit 17 includes, for example, an N-channel type MOS transistor M3 that is diode-connected between the node N3 and the ground voltage terminal GND. A reference bias voltage Vb is generated based on the reference current I0 flowing through the MOS transistor M3 and the resistive component of the MOS transistor M3.

The startup circuit 18 starts the operation of the bandgap reference circuit 1*c* by supplying a startup current to the non-inverting input terminal of the operational amplifier A2 (i.e., the node N2) when the supply of the power supply voltage is started. For example, when the startup circuit 18 detects that the bandgap reference circuit 1*c* is not operating when the supply of the power supply voltage is started, the startup circuit 18 forcefully makes the bandgap reference circuit 1*c* start to operate by controlling the voltage of the non-inverting input terminal of the operational amplifier A2.

When the reference voltage Vbgr reaches a predetermined level, the startup detection circuit 20 externally transmits information about that state. As a result, for example, an external circuit changes its mode from a suspended mode to an operating mode.

The reference voltage and reference current generation section 19 generates a plurality of reference voltages Vref1 to Vrefp (p is an arbitrary natural number) and a plurality of reference currents Iref1 to Irefq (q is an arbitrary natural number), which are required for an external circuit, based on the reference voltage Vbgr.

(Details of Reference Voltage and Reference Current Generation Section 19)

Figure 27:
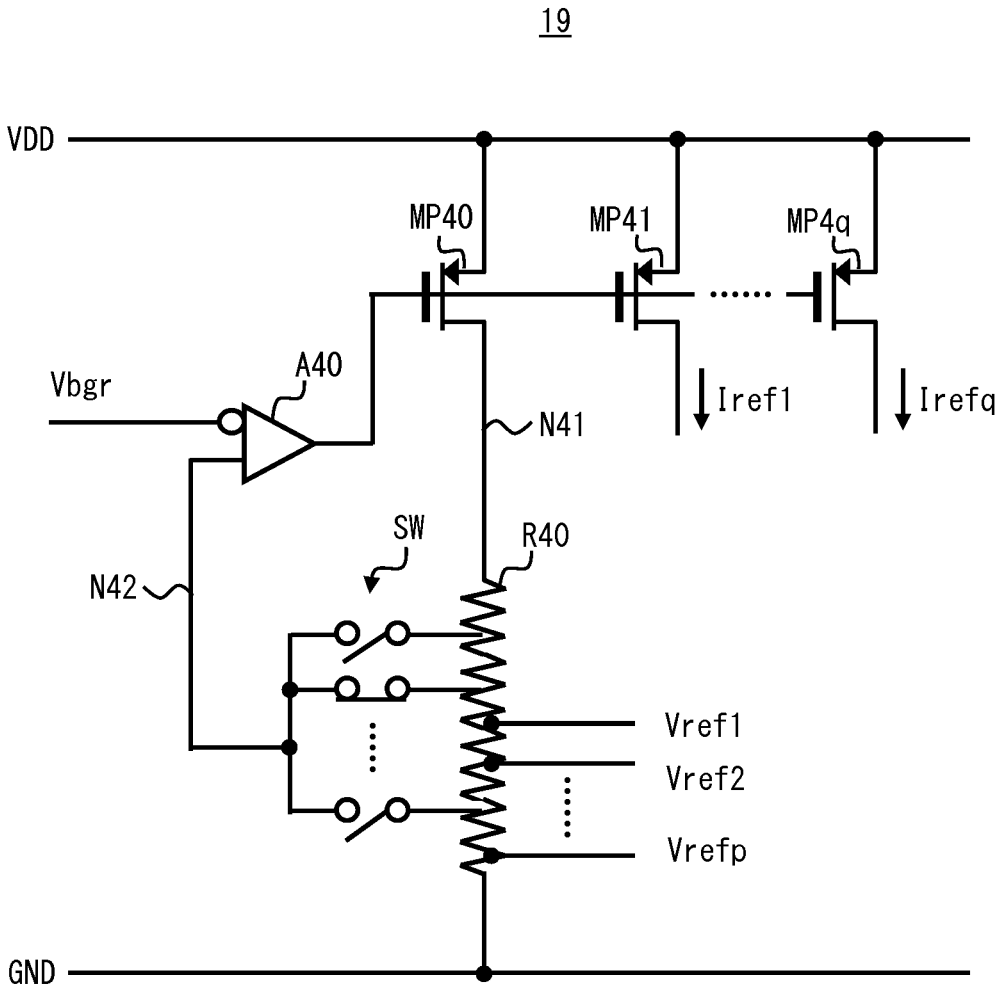
FIG. 27 shows a reference voltage and reference current generation section provided in the reference voltage and reference current generation circuit shown in FIG. 25.

FIG. 27 is a circuit diagram showing details of the reference voltage and reference current generation section 19.

As shown in FIG. 27, the reference voltage and reference current generation section 19 includes a P-channel type MOS transistor MP40, P-channel type MOS transistors MP41 to MP4*q*, an operational amplifier A40, a resistive element R40, and a plurality of switches SWs.

The source of the MOS transistor MP40 is connected to the power supply voltage terminal VDD, and the drain of the MOS transistor MP40 is connected to a node N41. Further, the output voltage of the operational amplifier A40 is supplied to the gate of the MOS transistor MP40. One end of the resistive element R40 is connected to the node N41 and the other end thereof is connected to the ground voltage terminal GND. Each of the plurality of switched SWs is disposed between a respective one of a plurality of nodes on the resistive element R40 and a node N42. Further, one of the plurality of switched SWs is turned on based on an externally supplied control signal. The operational amplifier A40 outputs a voltage according to a potential difference between the reference voltage Vbgr and the potential at the node N42.

The source of each of the MOS transistors MP41 to MP4*q* (i.e., q MOS transistors) is connected to the power supply voltage terminal VDD, and the output voltage of the operational amplifier A40 is supplied to the gate of each of the MOS transistors MP41 to MP4*q*. Further, reference currents Iref1 to Irefq are output from the drains of the MOS transistors MP41 to MP4*q*, respectively. Further, voltages at the plurality of nodes on the resistive element R40 are output as reference voltages Vref1 to Vrefp, respectively.

As described above, the reference voltage and reference current generation circuit 2 can generate accurate reference voltages Vref1 to Vrefp and accurate reference currents Iref1 to Irefq irrespective its temperature by using the bandgap reference circuit 1*c*.

(Electronic System Including Semiconductor Device 3 in which Reference Voltage and Reference Current Generation Circuit 2 is Provided)

Figure 28:
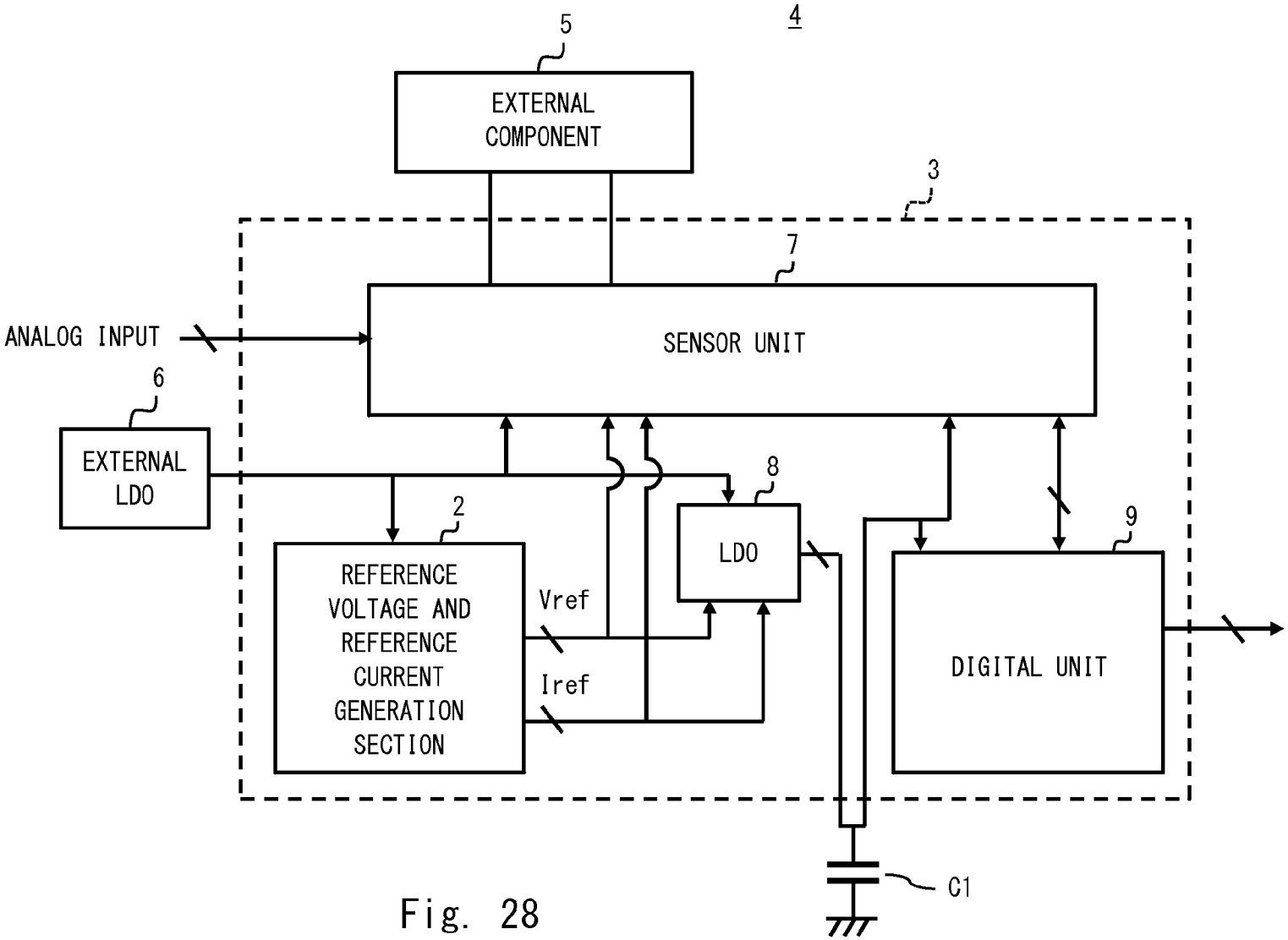
FIG. 28 is a block diagram showing an electronic system including a semiconductor device in which the reference voltage and reference current generation circuit shown in FIG. 25 is provided.

FIG. 28 is a block diagram showing an electronic system 4 including a semiconductor device 3 in which the reference voltage and reference current generation circuit 2 is provided.

As shown in FIG. 28, the electronic system 4 includes a semiconductor device 3, an external component 5, an external LDO (Low Drop Out) regulator 6, and a capacitor C1. The semiconductor device 3 includes a reference voltage and reference current generation circuit 2, a sensor unit 7, an LDO regulator 8, and a digital unit 9.

The reference voltage and reference current generation circuit 2 is driven by a power supply voltage supplied form an external LDO regulator 6, and outputs a reference voltage Vref and a reference current Iref. The LDO regulator 8 is driven by the power supply voltage supplied form the external LDO regulator 6, and generates an internal power supply voltage according to the reference voltage Vref and the reference current Iref. After its noises are removed by the capacitor C1, the generated internal power supply voltage is supplied to internal circuits such as the sensor unit 7 and the digital unit 9.

The sensor unit 7 is driven by the power supply voltage supplied form the external LDO regulator 6 and the internal power supply voltage supplied from the LDO regulator 8, and converse an externally input analog signal into a digital signal, for example, by using the reference voltage Vref and the reference current Iref and transmits the generated digital signal to the digital unit 9. The sensor unit 7 also transmits/receives signals to/from the external component 5. The digital unit 9 preforms certain processing on the digital signal received from the sensor unit 7 and outputs a processing result, for example, to an external circuit.

The electronic system 4 is merely an example of a system in which the reference voltage and reference current generation circuit 2 is provided, and can be changed or modified as desired to other circuit configurations in which the reference voltage and reference current generation circuit 2 is provided.

As described above, each of the current generation circuits according to the above-described first and sixth to eighth embodiments includes a gate grounding circuit (MOS transistors M1 and M2) in place of the operational amplifier on the PTAT current generation loop. As a result, each of the current generation circuits according to the above-described first and sixth to eighth embodiments does not require any operational amplifier disposed on the PTAT current generation loop and hence is able to accurately output a current having positive temperature dependence.

Further, in each of the current generation circuits according to the above-described first and sixth to eighth embodiments, the PTAT current generation loop including no operational amplifier is formed by using PNP type bipolar transistors. Therefore, they can be formed even in an environment where no NPN type bipolar transistor can be used.

Further, in each of the current generation circuits according to the above-described first and sixth to eighth embodiments, the drain voltage of the MOS transistors M1 and M2 is fixed by using the operational amplifiers A1 and A2. By doing so, the drain voltage of the MOS transistors M1 and M2 is biased at a low voltage, thus making it possible to operate them at a low voltage.

Further, each of the bandgap reference circuits according to the above-described second to eighth embodiments can generate a constant reference voltage Vbgr irrespective of its temperature by using the above-described current generation circuit. Further, the reference voltage and reference current generation circuit according to the above-described ninth embodiment and the semiconductor device using it can carry out desired operations by using the above-described bandgap reference circuit.

(Differences from Related Art)

Each of the configurations disclosed in Japanese Unexamined Patent Application Publications No. 2011-198093 and No. 2011-81517 requires an additional circuit for reducing the influence of the offset voltage of the operational amplifier. Therefore, the circuit size and the cost increase.

Further, the configuration disclosed in Japanese Unexamined Patent Application Publication No. 2011-198093 requires the measurement of an offset amount and the compensation control of a reference voltage. Therefore, the cost for tests that are carried out at the time of shipment increases. Further, in the configuration disclosed in Japanese Unexamined Patent Application Publication No. 2011-81517, the connection destinations of the input and output terminals of an operational amplifier are switched. This switching needs to be repeated at a frequency equal to or higher than the cut-off frequency of the subsequent low-pass filter. Therefore, when an external circuit to which the reference voltage is supplied is not in synchronization with the switching timing or when the external circuit is a continuous time circuit, there is a possibility that the characteristic deteriorates due to the residual errors that cannot be removed by the low-pass filter.

In contrast to this, the current generation circuits according to the above-described embodiments and the bandgap reference circuits including them do not include any operational amplifier on the current paths through which currents having positive temperature dependence flow in the first place. Therefore, the above-described problems do not occur in the current generation circuits and the bandgap reference circuits according to the above-described embodiments.

The present invention made by the inventors has been explained above in a specific manner based on embodiments. However, the present invention is not limited to the above-described embodiments, and needless to say, various modifications can be made without departing from the spirit and scope of the present invention.

For example, the semiconductor device according to the above-described embodiment may have a configuration in which the conductivity type (p-type or n-type) of the semiconductor substrate, the semiconductor layer, the diffusion layer (diffusion region), and so on may be reversed. Therefore, when one of the n-type and p-type is defined as a first conductivity type and the other is defined as a second conductivity type, the first and second conductivity types may be the p-type and n-type, respectively. Alternatively, the first and second conductivity types may be the n-type and p-type, respectively.

The first to ninth embodiments can be combined as desirable by one of ordinary skill in the art.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A bandgap reference circuit comprising:

a first bipolar transistor, a base and a collector of the first bipolar transistor being connected to each other;

a second bipolar transistor, a base and a collector of the second bipolar transistor being connected to each other;

a third bipolar transistor having the same conductivity type as that of the first and second bipolar transistors, a base and a collector of the third bipolar transistor being connected to each other;

a first current distribution circuit that makes a first current and a second current flow between the collectors and emitters of the first and second bipolar transistors, respectively, the first current corresponding to a first control voltage, the second current being in proportion to the first current;

a first NMOS transistor disposed between the first bipolar transistor and the first current distribution circuit, a gate of the first NMOS transistor being supplied with a second control voltage;

a second NMOS transistor disposed between the second bipolar transistor and the first current distribution circuit, a gate of the second NMOS transistor being supplied with the second control voltage;

a first resistive element disposed between the second NMOS transistor and the second bipolar transistor;

a second resistive element disposed between the third bipolar transistor and the first current distribution circuit;

a third resistive element disposed in parallel with the second resistive element and the third bipolar transistor;

a first operational amplifier that generates the second control voltage according to a drain voltage of the first NMOS transistor and a reference bias voltage; and a second operational amplifier that generates the first control voltage according to a drain voltage of the second NMOS transistor and the reference bias voltage, wherein the first current distribution circuit further makes a third current, in proportion to the first and second currents, flow between the collector and an emitter of the third bipolar transistor, wherein the bandgap reference circuit outputs a voltage at a node on a current path extending from the first current distribution circuit to the second resistive element.

2. The bandgap reference circuit according to claim 1, wherein the first and second bipolar transistors are both PNP bipolar transistors.

3. The bandgap reference circuit according to claim 1, wherein the first and second NMOS transistors are both depletion or native MOS transistors.

4. The bandgag reference circuit according to claim 1, further comprising:

a first supplementary resistive element disposed between the collector and the emitter of the first bipolar transistor; and a second supplementary resistive element disposed between the collector and the emitter of the second bipolar transistor.

5. The bandgag reference circuit according to claim 4, wherein the first current distribution circuit further makes a third current in proportion to the first and second currents that flow through the second resistive element, wherein the bandgap reference circuit outputs a voltage at a node on a current path extending from the first current distribution circuit to the second resistive element.

6. The bandgap reference circuit according to claim 1, wherein the second resistive element has a fixed resistor.

7. A semiconductor device comprising:

the bandgap reference circuit according to claim 1; and a reference voltage current generation section that outputs at least one of a reference voltage and a reference current based on the voltage output from the bandgap reference circuit.

8. The bandgap reference circuit according to claim 1, wherein the second resistive element is a variable resistor.

9. The bandgap reference circuit according to claim 8, wherein the variable resistor sets a resistance value between an output terminal of the bandgap reference circuit and the third bipolar transistor according to a first control signal, and set a resistance value between the first current distribution circuit and the third bipolar transistor according to a second control signal.

10. A bandgap reference circuit comprising:

a first bipolar transistor, a base and a collector of the first bipolar transistor being connected to each other;

a second bipolar transistor, a base and a collector of the second bipolar transistor being connected to each other;

a first current distribution circuit that makes a first current and a second current flow between the collectors and emitters of the first and second bipolar transistors, respectively, the first current corresponding to a first control voltage, the second current being in proportion to the first current;

a first NMOS transistor disposed between the first bipolar transistor and the first current distribution circuit, a gate of the first NMOS transistor being supplied with a second control voltage;

a second NMOS transistor disposed between the second bipolar transistor and the first current distribution circuit, a gate of the second NMOS transistor being supplied with the second control voltage;

a first resistive element disposed between the second NMOS transistor and the second bipolar transistor;

a first operational amplifier that generates the second control voltage according to a drain voltage of the first NMOS transistor and a reference bias voltage; and a second operational amplifier that generates the first control voltage according to a drain voltage of the second NMOS transistor and the reference bias voltage a second resistive element coupled with the current generation circuit, and where the first current distribution circuit further makes a third current, in proportion to the first and second currents, flow through the second resistive element;

a third resistive element connected in parallel with the second resistive element;

a second current distribution circuit that makes a fourth current flow through the third resistive element and further makes a fifth current, in proportion to the fourth current, flow through the second resistive element through which the third current also flows; and a third NMOS transistor disposed between the third resistive element and the second current distribution circuit, a gate of the third NMOS transistor being supplied with the second voltage, wherein the bandgap reference circuit outputs a voltage according to a resistance value of the second resistive element and a value of a current flowing through the second resistive element.

* * * * *